US011959244B2

(12) United States Patent
Meier et al.

(10) Patent No.: US 11,959,244 B2
(45) Date of Patent: Apr. 16, 2024

(54) ROLLER TOOL FOR A GROUND PROCESSING ROLLER

(71) Applicant: Hamm AG, Tirschenreuth (DE)

(72) Inventors: Matthias Meier, Tirschenreuth (DE); Marina Striegl, Altenstadt (DE)

(73) Assignee: HAMM AG, Tirschenreuth (DE)

( * ) Notice: Subject to any disclaimer, the term of this patent is extended or adjusted under 35 U.S.C. 154(b) by 116 days.

(21) Appl. No.: 17/533,565

(22) Filed: Nov. 23, 2021

(65) Prior Publication Data

US 2022/0170222 A1 Jun. 2, 2022

(30) Foreign Application Priority Data

Nov. 27, 2020 (DE) ..... 10 2020 131 448.5

(51) Int. Cl.
*E02D 3/026* (2006.01)
*E01C 21/00* (2006.01)

(52) U.S. Cl.
CPC ..... *E02D 3/0265* (2013.01); *E01C 21/00* (2013.01)

(58) Field of Classification Search
CPC ..... E01C 19/236; E01C 23/127; E02D 3/026; E02D 3/0265; E02F 3/20; E02F 9/2866
See application file for complete search history.

(56) References Cited

U.S. PATENT DOCUMENTS

| | | | | |
|---|---|---|---|---|
| 7,108,452 | B2 * | 9/2006 | Caron | E02D 3/026 404/124 |
| 8,690,475 | B2 * | 4/2014 | Springer | E02D 3/039 404/121 |
| 9,206,576 | B2 * | 12/2015 | Meier | E02D 3/026 |
| 9,376,775 | B2 * | 6/2016 | Meier | E01C 19/236 |
| 9,382,673 | B2 * | 7/2016 | Meier | E02D 3/039 |
| 10,378,187 | B2 * | 8/2019 | Flahive | E02F 9/2816 |
| 2017/0254201 | A1 * | 9/2017 | McCall | E21C 35/19 |
| 2023/0127739 | A1 * | 4/2023 | Meier | E02D 3/039 404/124 |
| 2023/0130272 | A1 * | 4/2023 | Meier | E02D 3/032 404/124 |

FOREIGN PATENT DOCUMENTS

| | | | | |
|---|---|---|---|---|
| DE | 12 97 042 | | 6/1969 | |
| DE | 2839292 | | 3/1980 | |
| DE | 102012200557 | A1 * | 7/2013 | E01C 23/12 |
| DE | 102020120381 | A1 * | 2/2022 | B06B 1/16 |
| EP | 2843135 | A1 * | 3/2015 | E01C 19/236 |
| WO | 2013107545 | | 7/2013 | |

* cited by examiner

*Primary Examiner* — Gary S Hartmann
(74) *Attorney, Agent, or Firm* — Rankin, Hill & Clark LLP

(57) ABSTRACT

A roller tool for a ground processing roller of a ground processing machine includes a tool carrier to be fixed on an outer circumferential side of a carrier cladding of a ground processing roller, a quick-change tool holder to be detachably fixed on the tool carrier, and an exchangeable tool to be detachably fixed on the quick-change tool holder.

24 Claims, 16 Drawing Sheets

ROLLER TOOL FOR A GROUND PROCESSING ROLLER

BACKGROUND

The present invention relates to a roller tool for a ground processing roller of a ground processing machine and a ground processing roller and a casing for a ground processing roller having a plurality of such roller tools.

A quick-change tool holder to be fixed on the outer circumference of a roller cladding of a compactor roller by welding for an exchangeable tool constructed, for example, like a chisel or a pad foot is known from WO 2013/107545 A2. In a side view, the quick-change tool holder has a trapezoidal contour and provides an exchangeable tool receptacle opening in a central region, in which a tool shaft of an exchangeable tool to be fixed on the quick-change tool holder can be positioned in an engaging manner.

BRIEF DESCRIPTION

It is the object of the present invention to provide a roller tool for a ground processing roller of a ground processing machine which, with structurally simple design, enables a replacement of an exchangeable tool to be carried out easily independently of a wear state.

This object is achieved according to the invention by a roller tool for a ground processing roller of a ground processing machine, comprising a tool carrier to be fixed on an outer circumferential side of a carrier cladding of a ground processing roller, a quick-change tool holder to be detachably fixed on the tool carrier, and an exchangeable tool to be detachably fixed on the quick-change tool holder.

In the structure according to the invention of a roller tool, not only the exchangeable tool, which is to be replaced after wear or to be exchanged for another ground processing operation is detachably coupled to a ground processing roller, but rather also the quick-change tool holder accommodating the exchangeable tool. Such a quick-change tool holder is also subject to massive wear in ground processing operation, so that, on the one hand, the replacement of such a worn quick-change tool holder is to be carried out easily and, on the other hand, due to the option of being able to detach the quick-change tool holder itself from the carrier cladding, the replacement of such an exchangeable tool is also easy to implement independently of the state of the quick-change tool holder. Only the tool carrier, which is protected by the quick-change tool holder from external influences and thus is itself subject to essentially no wear, is fixedly coupled to the carrier cladding, for example by welding. This also permits such a tool carrier to be constructed using a material which is particularly suitable for the attachment to the carrier cladding, but is less resistant to wear than the structural material to be used for the quick-change tool holder or the exchangeable tool. It is to be noted that in the meaning of the present invention, the nondetachable attachment of the tool carrier to the carrier cladding means that in principle the tool carrier is not to be detached from the carrier cladding in order to replace an exchangeable tool and/or a quick-change tool holder. This nondetachable connection can be produced, for example, by material bonding, thus, for example welding, so that this connection generated by material bonding would have to be destroyed to be able to detach a tool carrier from the carrier cladding. In principle, however, the nondetachable connection could also be produced by a screw connection, wherein this screw connection is also not to be detached, thus the tool carrier remains on the carrier cladding when an exchangeable tool or a quick-change tool holder is to be detached from the carrier cladding and replaced.

To be able to detachably couple the quick-change holder to the tool carrier easily, on the one hand, but also be able to integrate the exchangeable tool into the quick-change tool holder, on the other hand, it is proposed that the quick-change tool holder comprise two quick-change tool holder body parts, wherein when the quick-change tool holder is fixed on the tool carrier, the two quick-change tool holder body parts form a tool carrier receptacle space accommodating the tool carrier and are fixed on the tool carrier by fastening elements. The tool carrier accommodated in the tool carrier receptacle space and thus enclosed by the quick-change tool holder is thus shielded against external influences.

For a simple structure which is to be implemented with the least possible number of different parts and is stable in operation, it is proposed that the two quick-change tool holder body parts be constructed essentially identical to one another, and/or that each quick-change tool holder body part has a tool carrier receptacle recess providing one part of the tool carrier receptacle space, and/or in that each quick-change tool holder body part has a carrier cladding contact surface, which is to be positioned facing toward an outer circumferential side of a carrier cladding and is fitted to an outer circumferential contour of the carrier cladding.

An external action also on the fastening elements fixing the quick-change tool holder body parts on the tool carrier can be substantially avoided in that each quick-change tool holder body part is fixable by at least one fastening element, preferably two fastening elements on the tool carrier, wherein each quick-change tool holder body part has, assigned to each fastening element fixing it on the tool carrier, a fastening element passage opening having an expanded fastening element head receptacle region.

In an embodiment particularly advantageous for a stable attachment of the quick-change tool holder on a carrier cladding, it can be provided that the tool carrier has, assigned to each quick-change tool holder body part, a body part contact surface and each quick-change tool holder body part has a tool carrier contact surface for contact on the assigned body part contact surface of the tool carrier, wherein the body part contact surfaces are arranged on sides of the tool carrier facing away from one another in such a way that a mutual distance of the body part contact surfaces of the tool carrier increases starting from a carrier cladding contact side of the tool carrier. The body part contact surfaces can be arranged essentially symmetrically with respect to a tool carrier center plane of the tool carrier. A wedge effect pre-tensioning a respective quick-change tool holder body part in the direction toward the carrier cladding and in contact thereon is thus generated by the design of the tool carrier when a respective quick-change tool holder body part is fixed by one or more fastening elements on the tool carrier.

This effect can also be strengthened in that the tool carrier contact surfaces of the two quick-change tool holder body parts are arranged complementary to the assigned body part contact surfaces of the tool carrier in such a way that when the quick-change tool holder body parts are fixed on the tool carrier, the mutual distance of the tool carrier contact surfaces of the two quick-change tool holder body parts increases in the direction away from the carrier cladding contact side.

To attach an exchangeable tool to a quick-change tool holder, the quick-change tool holder can have an exchangeable tool receptacle opening for accommodating a tool shaft, which extends in the direction of a shaft longitudinal axis from an exchangeable tool body, of the exchangeable tool to be fixed on the quick-change tool holder.

In particular if identical parts are used for the two quick-change tool holder body parts, each quick-change tool holder body part can have an exchangeable tool receptacle recess providing a part of the quick-change tool receptacle opening.

To achieve a form fit between an exchangeable tool and the quick-change tool holder accommodating it, it is proposed that the tool shaft have an engagement recess which is preferably completely circumferential around the shaft longitudinal axis, and that each quick-change tool holder body part has an engagement projection to be positioned in an engaging manner in the engagement recess in the region of the exchangeable tool receptacle recess. The engagement projections of the two quick-change tool holder body parts can together form an essentially ring-like engagement region when the quick-change tool holder is fixed on the tool carrier.

The engagement recess can be delimited in the direction away from the exchangeable tool body by an engagement recess end face, wherein the engagement recess end face is angled with respect to the shaft longitudinal axis in such a way that a distance of the engagement recess end face from the exchangeable tool body increases starting from a recess bottom. A wedge effect is thus achieved which pre-tensions an exchangeable tool in the direction toward the quick-change tool holder and therefore in contact with it.

This effect can be further assisted in that the engagement projection is delimited by an engagement projection end face on each quick-change tool holder body part, wherein when the exchangeable tool is fixed on the quick-change tool holder, the engagement projection end face is oriented in the direction away from the exchangeable tool body and is angled with respect to the shaft longitudinal axis in such a way that a distance of the engagement projection end face to the exchangeable tool body decreases in the direction to a projection vertex of the engagement projection.

To transmit forces occurring in ground processing operation and acting on an exchangeable tool to the associated quick-change tool holder, an exchangeable tool support surface surrounding the exchangeable tool receptacle opening can be provided on the quick-change tool holder.

If identical parts are used for the two quick-change tool holder body parts, a partial surface of the exchangeable tool support surface can be provided on each quick-change tool holder body part.

In an alternative embodiment, in which an exchangeable tool can be fixed in a simple manner but still stably on the quick-change tool holder, the exchangeable tool receptacle opening can be formed completely in one of the quick-change tool holder body parts.

To fix an exchangeable tool on the one of the quick-change tool holder body parts, it is proposed here that a passage opening for an exchangeable tool fastening element fixing the tool shaft with respect to the one quick-change tool holder body part is provided in a receptacle opening bottom of the exchangeable tool receptacle opening.

For the stable support of an exchangeable tool on the quick-change tool holder, an exchangeable tool support surface surrounding the exchangeable tool receptacle opening can be provided on the one quick-change tool holder body part. Furthermore, to provide an essentially step-free outer circumferential contour in the transition between the two quick-change tool holder body parts, a quick-change tool holder body part receptacle recess accommodating the other quick-change tool holder body part can be provided in the one quick-change tool holder body part.

A stable contact interaction free of play can be achieved in this structure in that when the quick-change tool holder is fixed on the tool carrier and the exchangeable tool is fixed on the quick-change tool holder, the exchangeable tool is pre-tensioned with a support region in contact on the quick-change tool holder. In particular, in this case the exchangeable tool can be pre-tensioned with its support region in contact on the quick-change tool holder by the engagement projections engaging in the engagement recess.

The support region can comprise a ring-like quick-change tool holder support surface enclosing the tool shaft at least in regions on the exchangeable tool body.

In another embodiment of an exchangeable tool, the support region on the exchangeable tool body can have a plurality of quick-change tool holder support sections arranged with radial distance to the shaft longitudinal axis and with circumferential distance around the shaft longitudinal axis in relation to one another. An exchangeable tool support section can be provided here on the quick-change tool holder assigned to each quick-change tool holder support section.

The present invention furthermore relates to a ground processing roller, comprising a roller cladding providing a carrier cladding and enclosing a roller rotational axis and a plurality of roller tools constructed according to the invention, wherein the tool carrier of each of the roller tools is preferably fixed on the roller cladding by material bonding.

To achieve a stable attachment to a ground processing roller, when a quick-change tool holder is fixed on a tool carrier, the quick-change tool holder can be pre-tensioned radially inward against the tool carrier and/or the roller cladding. If the quick-change tool holder is pre-tensioned radially inward only against the tool carrier, there is essentially no direct contact between the quick-change tool holder and an outer circumferential side of the roller cladding. If the quick-change tool holder is pre-tensioned radially inward only against the roller cladding, the quick-change tool holder is essentially not pre-tensioned radially inward against the tool carrier, but rather supports itself radially outward on the tool carrier to generate the pre-tension against the roller cladding. Furthermore, the present invention relates to a casing for a ground processing roller, comprising a plurality of casing segments providing a carrier cladding and to be arranged casing a roller cladding of a ground processing roller enclosing a roller rotational axis and a plurality of roller tools constructed according to the invention, wherein the tool carrier of each of the roller tools is fixed on one of the casing segments, preferably by material bonding.

It can also be provided in such an embodiment that when a quick-change tool holder is fixed on a tool carrier, the quick-change tool holder is pre-tensioned radially inward against the tool carrier and/or the roller cladding.

BRIEF DESCRIPTION OF THE DRAWINGS

The invention is described in more detail hereinafter with reference to the appended drawings. In the figures.

DETAILED DESCRIPTION

Figure 31:
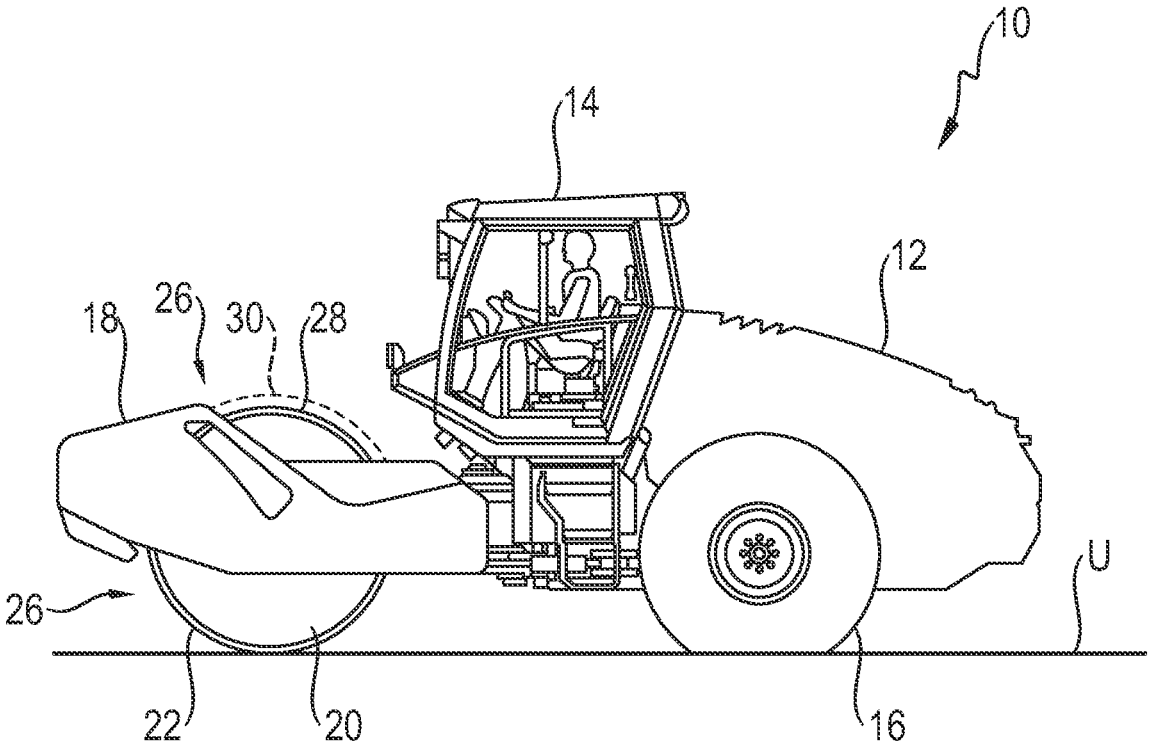
FIG. 31 shows a side view of a ground processing machine designed as a soil compactor having a ground processing roller.

Before the structure of roller tools to be provided on a soil compaction roller is described in more detail hereinafter with reference to FIGS. 1 to 30, the structure of a ground processing machine on which such roller tools can be used, will be described with reference to FIG. 31.

The ground processing machine 10, which is constructed in principle as a soil compactor, comprises a control stand 14 on a rear carriage 12 and wheels 16 driven by a drive assembly provided on the rear carriage 12. A ground processing roller 20 is carried rotatably around a roller rotational axis orthogonal to the plane of the drawing of FIG. 31 on a front carriage 18 pivotably connected to the rear carriage 12 around an essentially vertical axis. A vibration exciter arrangement can be provided in the interior of the ground processing roller 20 in order to generate a vibrational acceleration essentially orthogonal to the roller rotational axis on the ground processing roller 20 or an oscillation acceleration essentially tangential to the roller rotational axis. The ground processing roller 20 moves over the underlying surface U to be processed using a roller cladding 22 enclosing the roller rotational axis. In the illustrated exemplary embodiment, the ground processing roller 20 is formed as a smooth roller and can be used, for example, for compacting soil, asphalt, or the like.

The roller tools described in detail hereinafter can be attached directly to the outer circumference of the ground processing roller 20 or the roller cladding 22, so that in this case the roller cladding 22 provides a carrier cladding 26 which bears the roller tools. In an embodiment indicated by a dashed line in FIG. 31, the ground processing roller 20 can be enclosed by a casing 30 constructed using a plurality of casing segments 28, on which the roller tools described in detail hereinafter can then be provided, so that the casing 30 or the casing segments 28, which are arranged successively in the circumferential direction and are fixedly connected to one another, provide the carrier cladding 26 in this embodiment.

Figure 1:
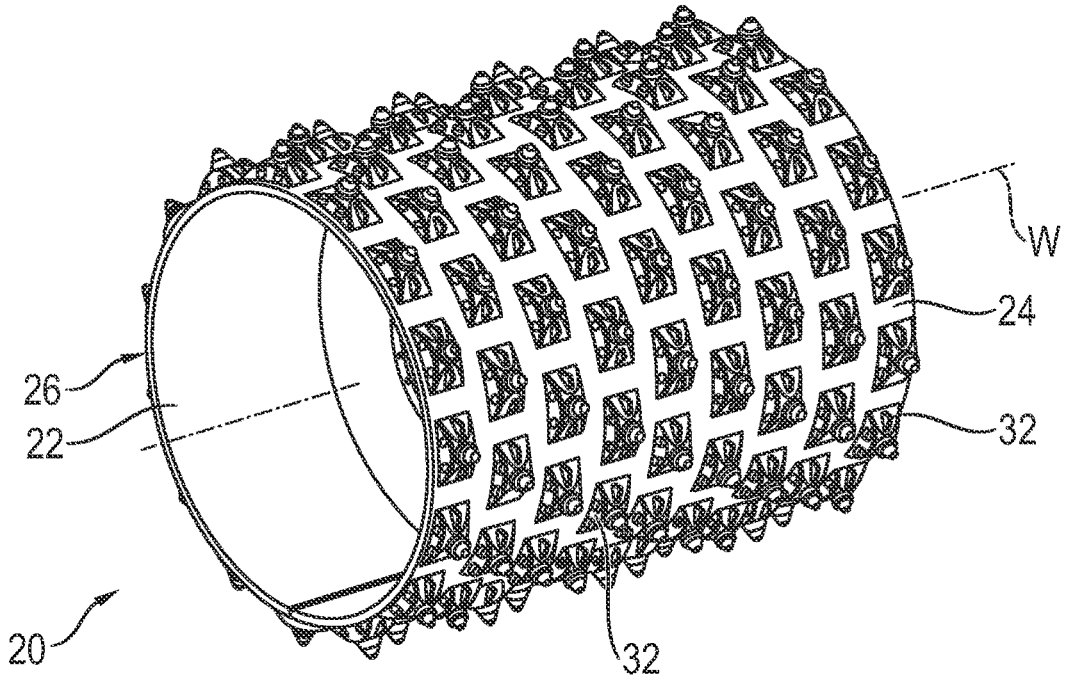
FIG. 1 shows a perspective view of a ground processing roller having a plurality of roller tools provided on the outer circumference thereof.

FIG. 1 shows such a ground processing roller 20, a plurality of roller tools 32 being provided on the roller cladding 22 providing the carrier cladding 26 thereof. The roller tools 32 are arranged on an outer circumferential side 24 of the roller cladding 22 or carrier cladding 26 in a ring enclosing a roller rotational axis W, wherein the roller tools 32 are arranged offset to one another in the circumferential direction in rings directly adjacent to one another in the direction of the roller rotational axis W.

Figure 3:
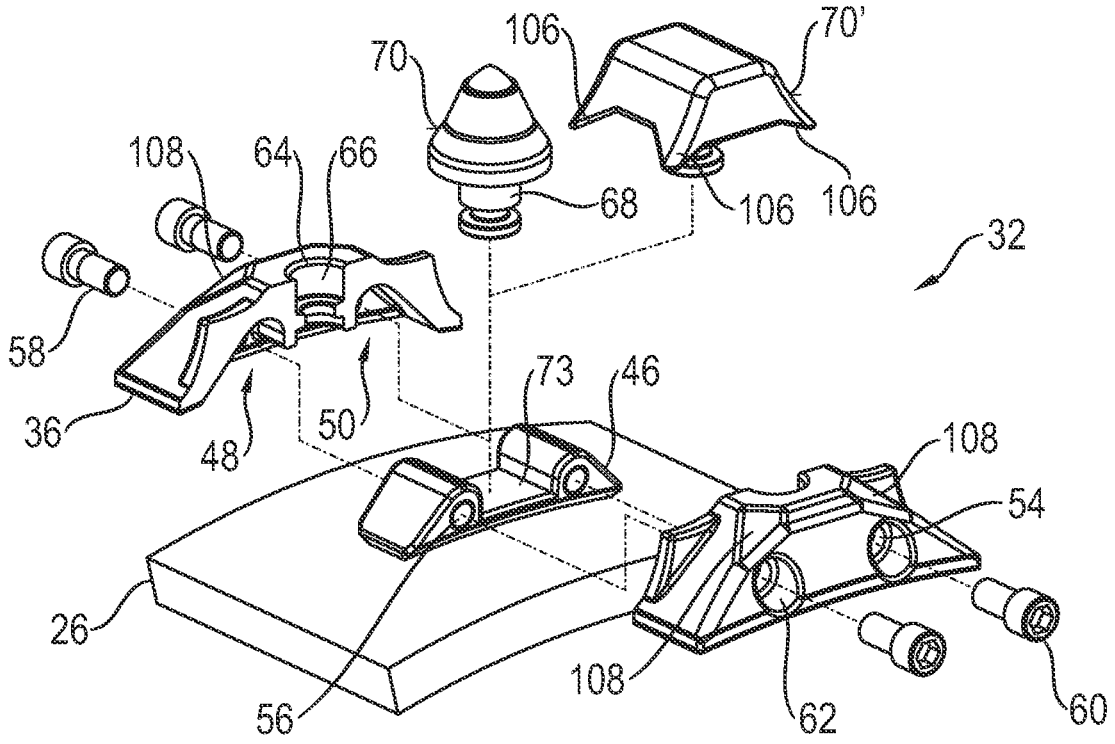
FIG. 3 shows a perspective exploded illustration of a roller tool.
Figure 4:
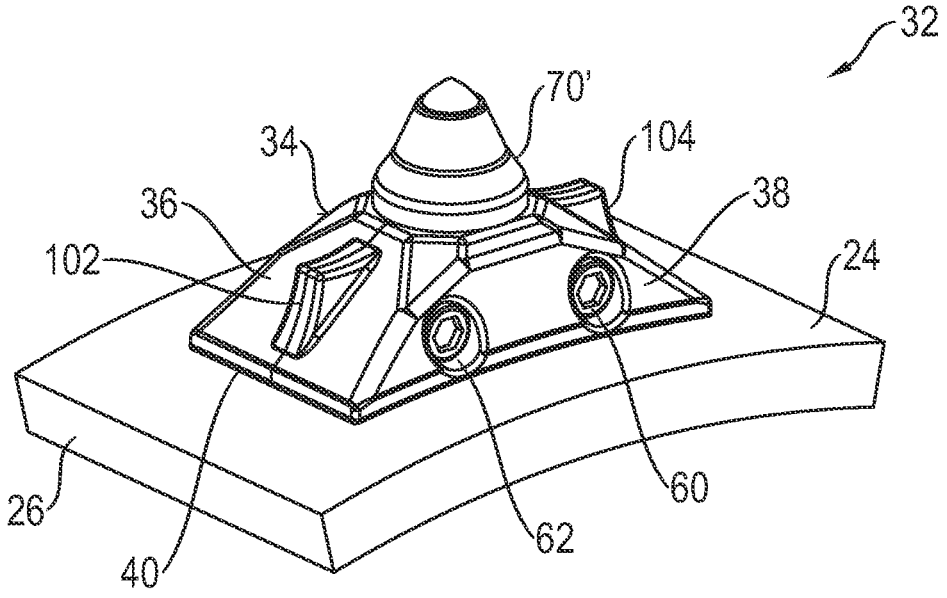
FIG. 4 shows the roller tool of FIG. 3 when assembled.
Figure 5:
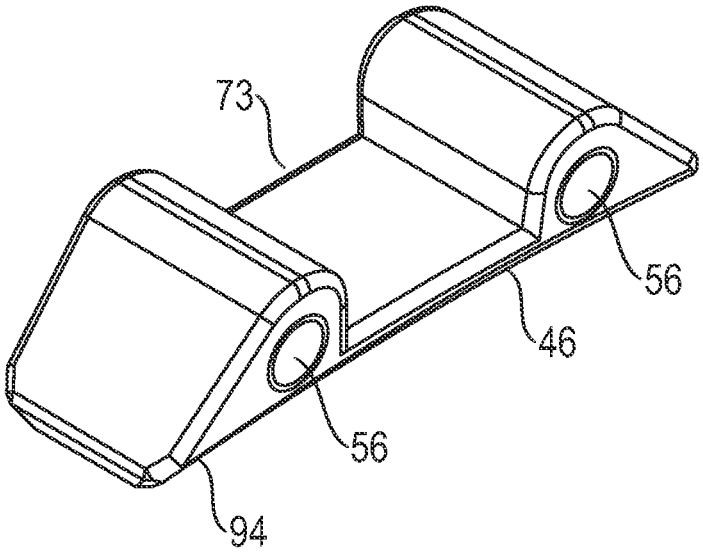
FIG. 5 shows a perspective view of a tool carrier of the roller tool of FIGS. 3 and 4.
Figure 6:
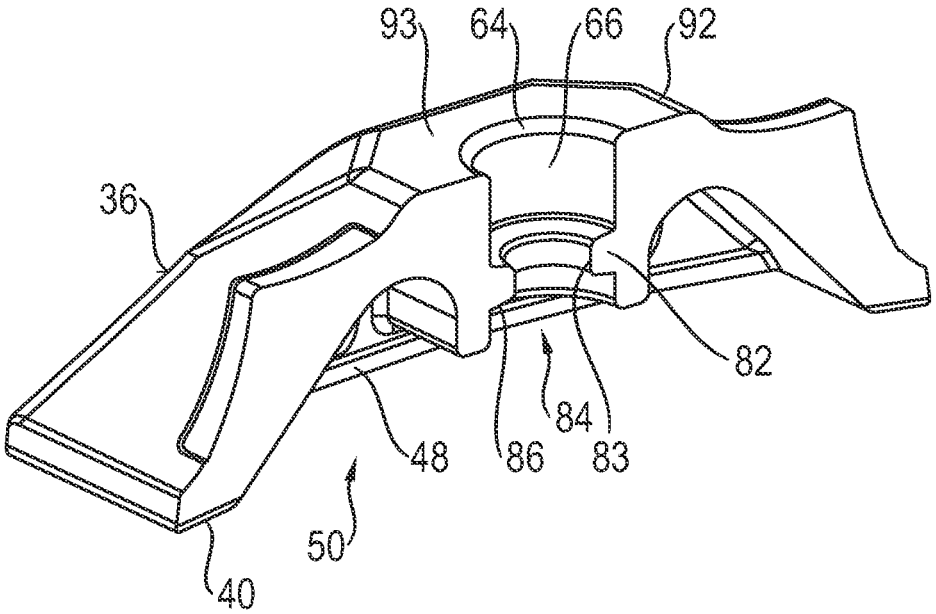
FIG. 6 shows a perspective view of one of the two quick-change tool holder body parts of the roller tool of FIGS. 3 and 4.
Figure 7:
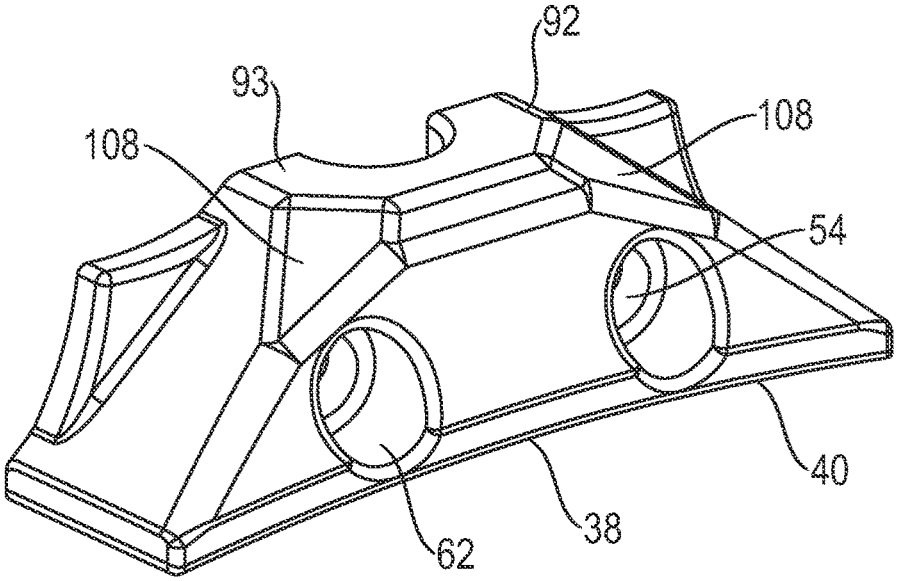
FIG. 7 shows a perspective view of the other of the two quick-change tool holder body parts of the roller tool of FIGS. 3 and 4.
Figure 8:
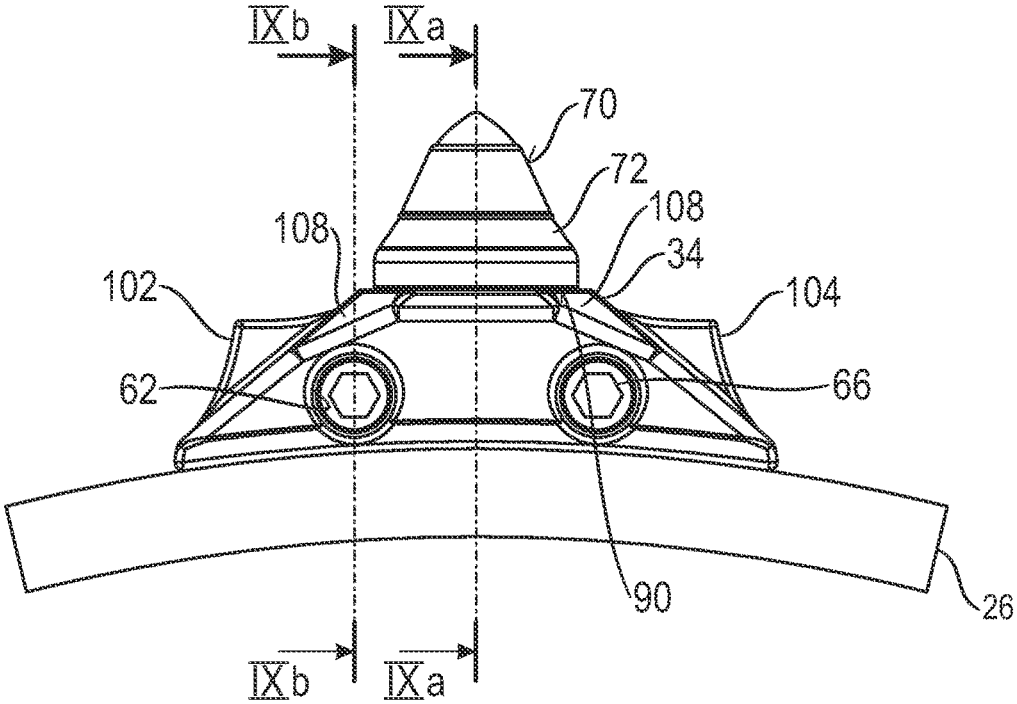
FIG. 8 shows a side view of the roller tool of FIGS. 3 and 4, viewed in the direction of a roller rotational axis of a ground processing roller bearing the roller tool.

FIGS. 3 and 4 show the fundamental structure of such a roller tool 32. Each roller tool 32 comprises a quick-change tool holder 34 having two quick-change tool holder body parts 36, 38, which are preferably essentially identical to one another. In its basic structure, the quick-change tool holder 32 corresponds to the structure of a quick-change tool holder known from WO 2013/107545 A2 and has a trapezoidal profile in a side view, thus in a view in the direction of the roller rotational axis W. Each of the two quick-change tool holder body parts 36, 38 provides a carrier cladding contact surface 40 matched to the circular outer circumferential contour of the roller cladding 22 providing the carrier cladding 26, with which the respective quick-change tool holder body part 36, 38 is applied in the assembled state to the outer circumferential side 24 of the carrier cladding 26 and, as described hereinafter, is held thereon under pretension.

Figure 2:
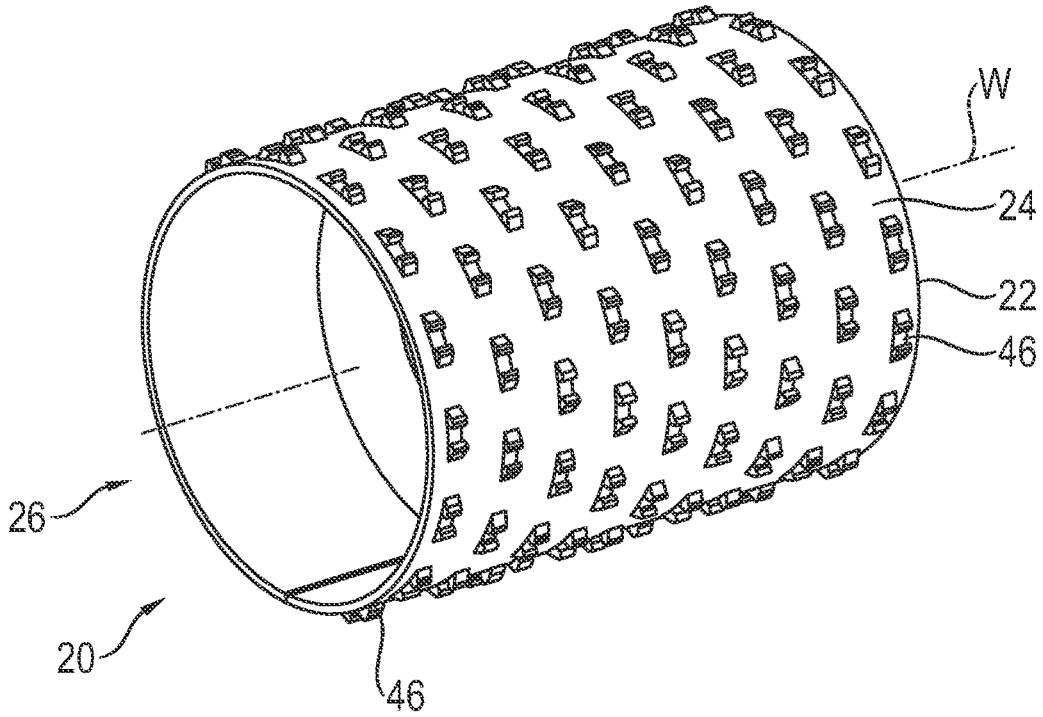
FIG. 2 shows the ground processing roller of FIG. 1 having tool carriers of the roller tools fixed on the outer circumference thereof.

The roller tool 32 furthermore comprises a tool carrier 46, which, as shown in FIG. 2 is fixed, for example, by welding, but possibly also by a screw connection, on the outer circumferential side 24 of the roller cladding 22 or carrier cladding 26 and thus specifies the position for a respective roller tool 32 on the ground processing roller 20.

Each of the two quick-change tool holder body parts 36, 38 provides a tool carrier receptacle recess 48. The tool carrier receptacle recesses 48 provide, in the assembled state, a tool carrier receptacle space 50, in which the associated tool carrier 46 is accommodated. The tool carrier 46 is thus completely shielded to the outside by the two quick-change tool holder body parts 36, 38 and protected from external influences.

Two fastening element passage openings 54 are provided in each quick-change tool holder body part 36, 38, through which fastening elements 58 formed as threaded bolts can be guided and screwed into internally threaded openings 56 formed in the tool carrier 46. To accommodate fastening element heads 60, the fastening element passage opening 54 are formed having expanded fastening element head receptacle regions 62. In the assembled state recognizable in FIG. 4, the fastening elements 58 are thus located completely in the interior of the quick-change tool holder body parts 36, 38, so that the fastening elements 58 and in particular the fastening element heads 60 are protected against damage or wear and can thus be detached easily even after a longer work operation by using an appropriate tool.

In a central region, the quick-change tool holder 34 provides an exchangeable tool receptacle opening 64. If the quick-change tool holder 34 is designed having two essentially identically constructed quick-change tool holder body parts 36, 38, an exchangeable tool receptacle recess 66 is provided in each of the quick-change tool holder body parts 36, 38. The exchangeable tool receptacle opening formed by the two exchangeable tool receptacle recesses 66 has an essentially cylindrical structure, in which a tool shaft 68 of an exchangeable tool 70, formed as a chisel, for example, can be accommodated. In the region in which the two quick-change tool holder body parts 36, 38 form the exchangeable tool receptacle opening 64, the tool carrier 46 has a recess 73, in which part of the quick-change tool holder 34 or the quick-change tool holder body parts 36, 38 providing the exchangeable tool receptacle opening 64 can be positioned in an engaging manner. The exchangeable tool 70 shown in FIG. 11 and designed in the form of a chisel has an exchangeable tool body 72 and a tool shaft 68 extending therefrom in the direction of a shaft longitudinal axis S. An engagement recess 76, which preferably completely encloses the shaft longitudinal axis S, is formed in the tool shaft 68, which has an essentially trapezoidal structure and is thus formed tapering radially inward toward a recess bottom 78. In particular, the engagement recess 76 thus provides an engagement recess end face 80 oriented facing toward the exchangeable tool body 72, which, as indicated by an auxiliary line $H_1$ in FIG. 10, is inclined with respect to the shaft longitudinal axis S at an angle different from 90° and has an increasing distance to the exchangeable tool body 72 from the radial inside to the radial outside, thus away from the recess bottom 78.

Engagement projections 82 assigned to the engagement recess 76 are formed on each of the two quick-change tool holder body parts 36, 38. The engagement projections 82 of the two quick-change tool holder body parts 36, 38 form an essentially ring-like engagement region 84 in the assembled state, which engages in the engagement recess 76 of an exchangeable tool 70 detachably fixed on the quick-change tool holder 34.

Figure 10:
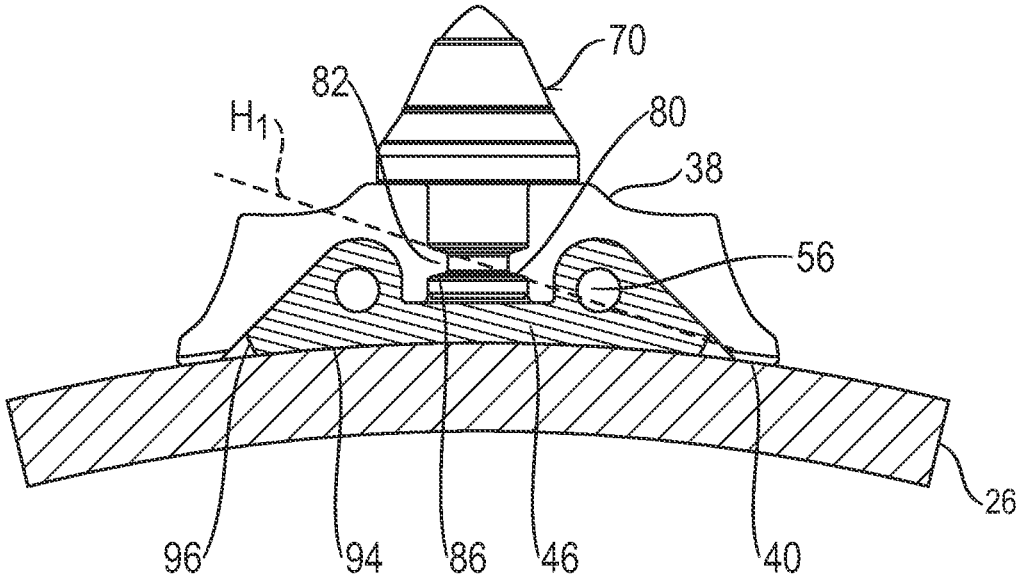
FIG. 10 shows a longitudinal sectional view of the roller tool of FIG. 8, in section along a line X-X in FIG. 9*b*)
Figure 11:
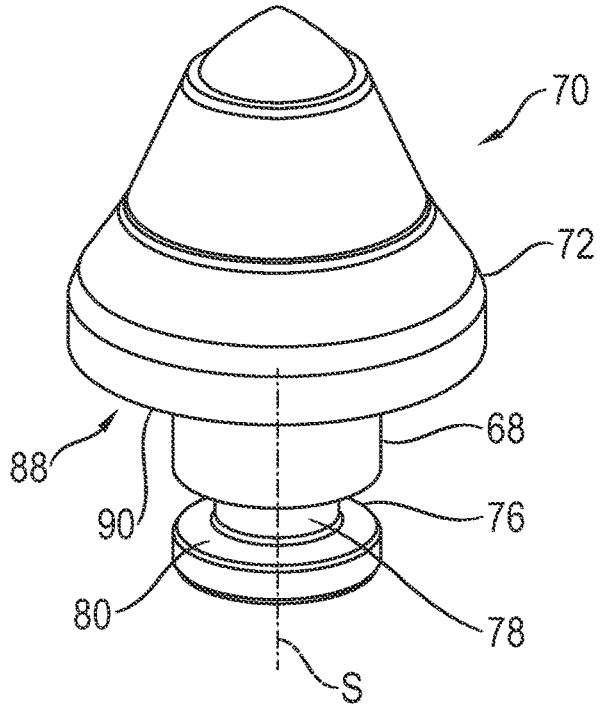
FIG. 11 shows a perspective view of an exchangeable tool formed as a chisel.

Each of the two engagement projections 82 of the quick-change tool holder body parts 36, 38 similarly has a trapezoidal structure matching the trapezoidal structure of the engagement recess 76 and is delimited on its side facing away from the exchangeable tool body 72 in the assembled state by an engagement projection end face 86, which, as similarly indicated by the auxiliary line $H_1$ in FIG. 10, is angled with respect to the shaft longitudinal axis S at an angle different from 90°, in particular at the same angle as the engagement recess end face 80. The engagement projections 82 are thus formed tapering in the direction toward a projection vertex 83.

The two engagement projections 82 of the quick-change tool holder body parts 36, 38 are dimensioned shorter in the direction of the shaft longitudinal axis S than the engagement recess 76, so that during assembly or in the assembled state, only the engagement recess end face 80 interacts with the engagement projection end faces 86, but in the other axial end region, the engagement projections 82 do not come into contact with the tool shaft 68. In this manner, during assembly or in the assembled state, a wedge-like interaction pre-tensioning the exchangeable tool 70 in the direction toward the quick-change tool holder 34 can be generated between the engagement projection end faces 86 of the two quick-change tool holder body parts 36, 38 and the engagement recess end face 80. The exchangeable tool 70 is thus pressed with a support region 88 formed on the exchangeable tool body 72, which is provided in the design of the exchangeable tool 70 as a chisel by a quick-change tool holder support surface 90 enclosing the tool shaft 68 like a ring, in contact on an exchangeable tool support surface 92 enclosing the exchangeable tool receptacle opening 64 like a ring on the quick-change tool holder 34. The exchangeable tool support surface 92 comprises a partial surface 93 on each of the quick-change tool holder body parts 36, 38.

In the design of a roller tool 32 according to the invention, the engagement projection 82 having a ring-like engagement projection end face 86 essentially completely enclosing the shaft longitudinal axis S provided thereon could also be provided on the tool shaft 68, while sections of the engagement recess 76 or the engagement recess end face 80 could then be formed on each of the quick-change tool holder body parts 36, 38.

Figure 9:
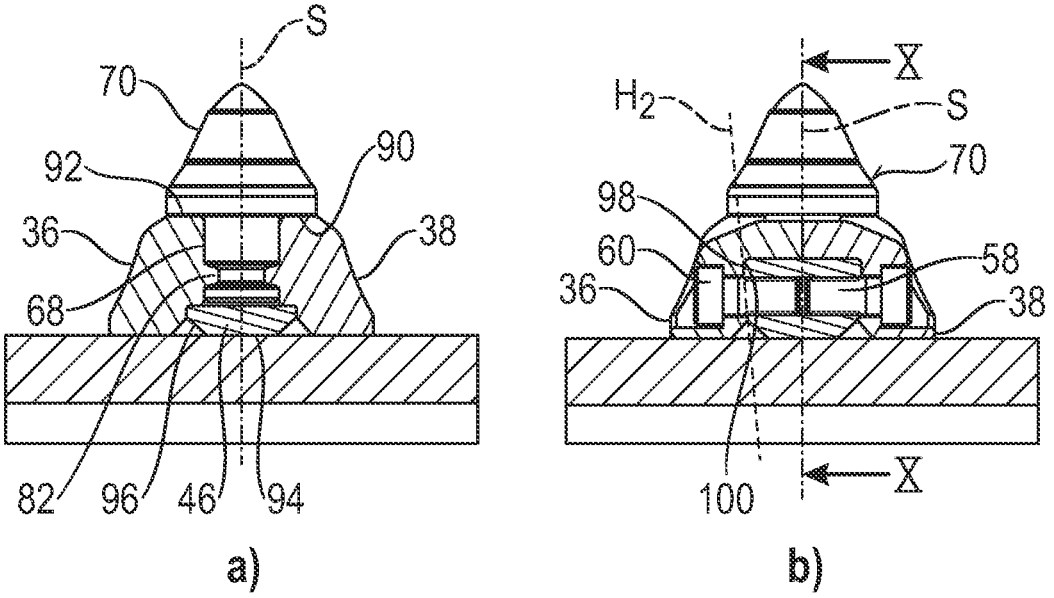
FIG. 9 shows, in its illustration a), a cross-sectional view of the roller tool shown in FIG. 8, in section along a line IXa-IXa in FIG. 8, and in its illustration b), a cross-sectional view of the roller tool of FIG. 8, in section along a line IXb-IXb in FIG. 8.

The tool carrier 46 abuts the outer circumferential side 24 of the carrier cladding 26 or, in the illustrated exemplary embodiment, of the roller cladding 22, with a carrier cladding contact side 94. In FIGS. 9 and 10, it can be seen that a chamfer 96 provided to accommodate a weld seam is formed on the outer circumferential region of the carrier cladding contact side 94.

The tool carrier 46 provides body part contact surfaces 98 on two sides facing away from one another, which are oriented during attachment on the carrier cladding 26 in the direction of the roller rotational axis W. These are inclined radially outward away from one another starting from their regions adjoining the carrier cladding contact side 94 or chamfer 96 and thus extend in the radial direction along an auxiliary line $H_2$ shown in FIG. 9*b*) at an angle to the shaft longitudinal axis S. The two body part contact surfaces 98 of the tool carrier 96 are preferably arranged symmetrically or mirror-symmetrically with respect to a center plane of the tool carrier 46 containing the shaft longitudinal axis S, so that the tool carrier 46 has a wedge-like or trapezoidal cross-sectional geometry expanding radially outward, thus in the direction away from the carrier cladding contact surface 94.

In correspondence with this angled positioning of the body part contact surfaces 98 with respect to the shaft longitudinal axis or the tool carrier center plane, each quick-change tool holder body part 36, 38 has a complementary angled tool carrier contact surface 100. Due to the interaction of the body part contact surfaces 98 with the respective assigned tool carrier contact surfaces 100, a wedge effect is achieved by which the quick-change tool holder body parts 36, 38 are pre-tensioned in the direction toward the carrier cladding 26, so that they press stably against the outside of the carrier cladding 26 with their carrier cladding contact surfaces 40 when the two quick-change tool holder body parts 36, 38 are loaded in the direction toward the tool carrier 46 by tightening the fastening elements 58.

During the assembly of an above-described roller tool 32, firstly the two quick-change tool holder body parts 36, 38 are moved laterally toward the tool carrier 46 fixed on the carrier cladding 26. During this approach of the quick-change tool holder body parts 36, 38 to the tool holder 46 and to one another, at the same time the tool shaft 68 of the exchangeable tool 70 can also be accommodated in the exchangeable tool receptacle recesses 66, wherein the engagement projections 82 engage in the engagement recess 76. At the same time, the engagement projection end faces 86 come into contact on the engagement recess end face 80 and thus load the exchangeable tool 70 in the direction toward the quick-change tool holder 34 with increasing approach of the quick-change tool holder body parts 36, 38 to one another, until this tool comes into contact on the exchangeable tool support surface 92 with its quick-change tool holder support surface 90. In the course of this mutual approach of the two quick-change tool holder body parts 36, 38, which is also induced or assisted by screwing the fastening element 58 into the associated internally threaded openings 56 of the tool carrier 46, the tool carrier contact surfaces 100 provided on the exchangeable tool body parts 36, 38 come into contact on the associated body part contact surfaces 98, whereby the entire quick-change tool holder 34 is pre-tensioned radially inward, thus toward the outer circumferential side 24 of the carrier cladding 26. In the assembled state, the quick-change tool holder 34 presses with the carrier cladding contact surfaces 40 of the quick-change tool holder body parts 36, 38 stably and without play against the outer circumferential side 24 of the carrier cladding 26. At the same time, the exchangeable tool 70 is stably pre-tensioned in contact against the exchangeable tool support surface 92 of the quick-change tool holder 34 and held on the quick-change tool holder 34. In this assembled state, breaking projections 102, 104 are then formed on the quick-change tool holder 34 both sides of the exchangeable tool 70 in the circumferential direction upon positioning on a carrier cladding 26, which assist the pulverizing of the underlying surface U to be processed, on the one hand, and protect the quick-change tool holder 34 from excess wear, on the other hand.

To exchange an exchangeable tool 70 or to replace worn quick-change tool holder body parts 36, 38, the fastening elements 58, which are fundamentally protected against external action, can be loosened and thus the quick-change tool holder body parts 36, 38 detachably held by the fastening elements 58 on the tool carrier 46 can be removed from the tool carrier 46, wherein the exchangeable tool 70 is also released. Those components detached from the tool holder 46 which are to be replaced due to wear or to carry out a different working operation can then be replaced.

Figure 12:
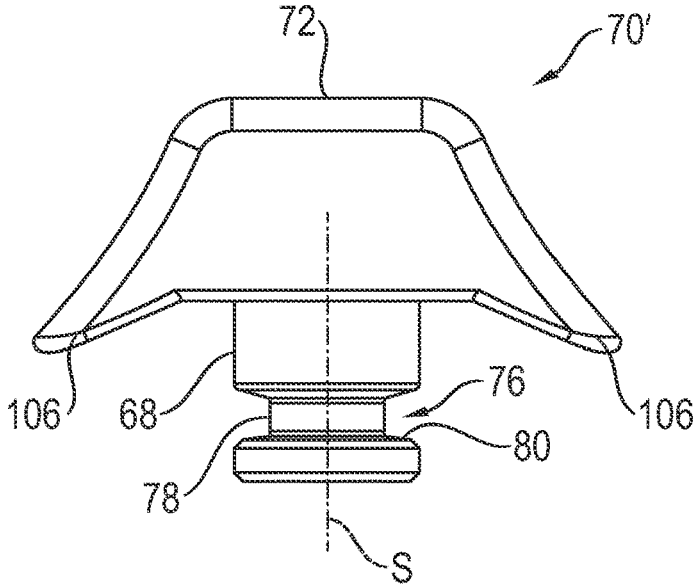
FIG. 12 shows a side view of an exchangeable tool formed as a pad foot.
Figure 13:
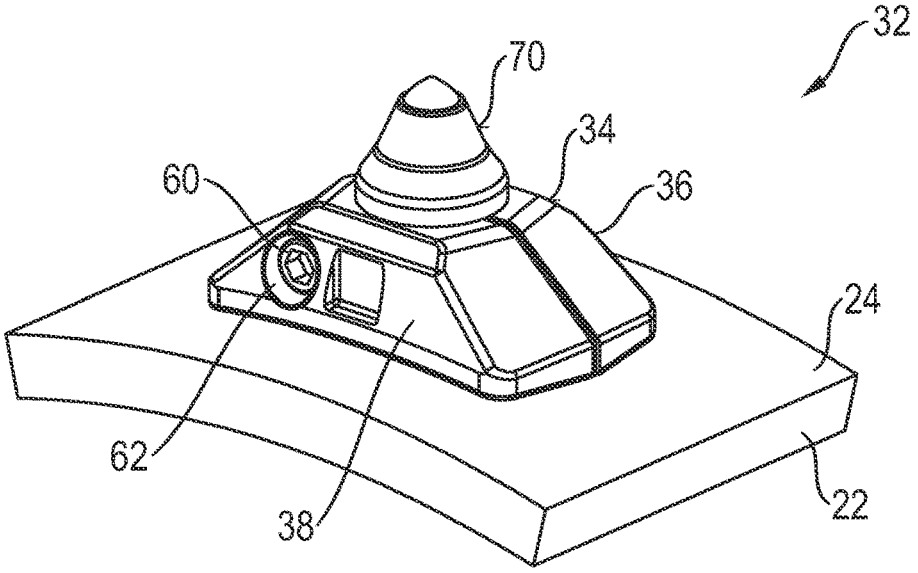
FIG. 13 shows a perspective view of an alternative embodiment of a roller tool.
Figure 14:
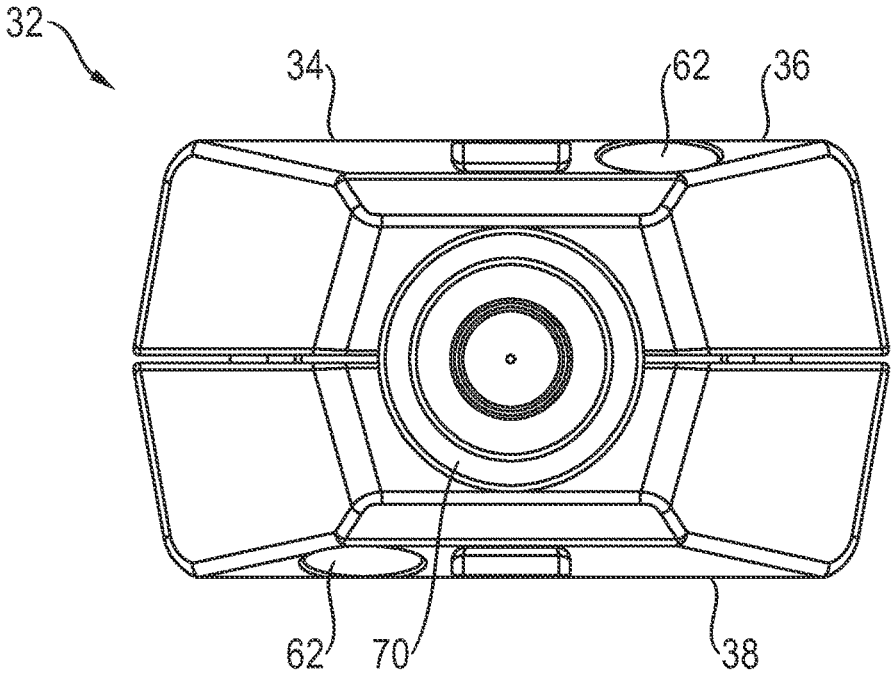
FIG. 14 shows a top view of the roller tool of FIG. 13.
Figure 15:
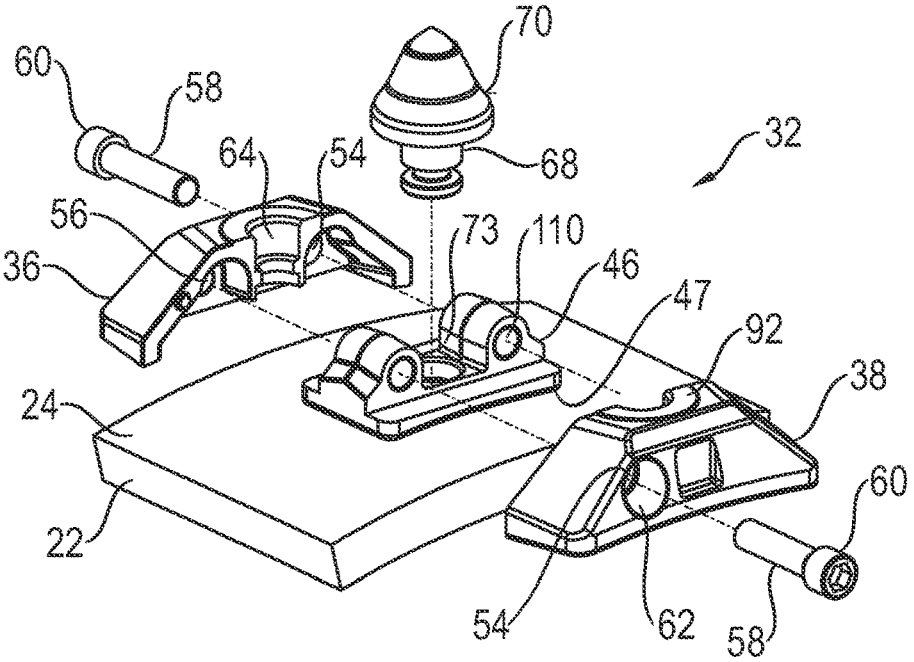
FIG. 15 shows a perspective exploded illustration of the roller tool of FIG. 13.
Figure 16:
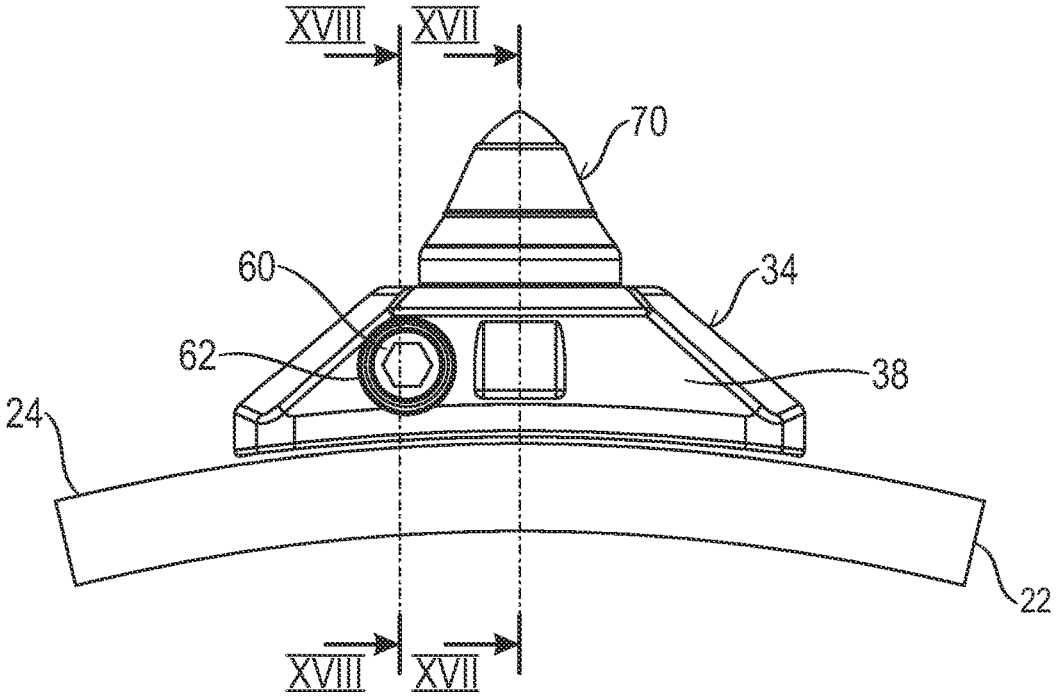
FIG. 16 shows a side view of the roller tool of FIG. 13.
Figure 17:
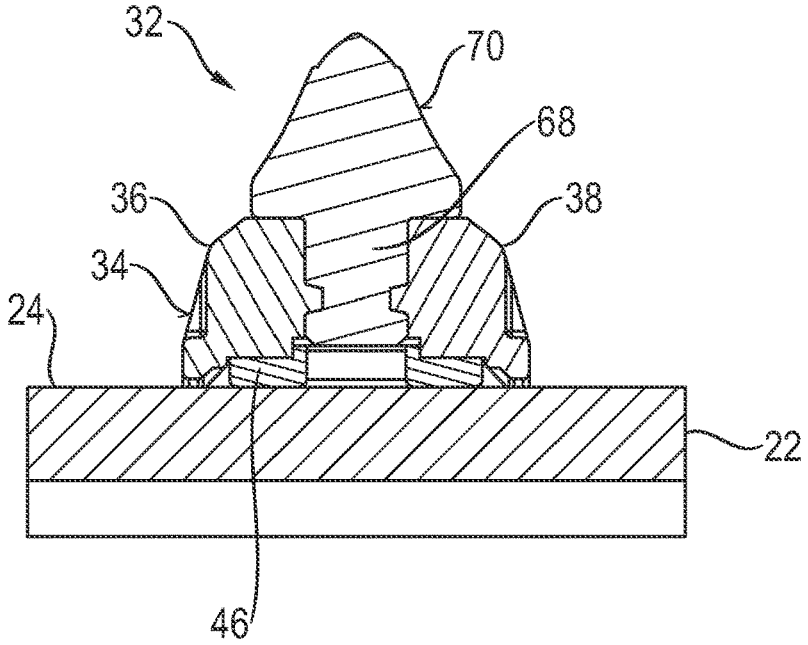
FIG. 17 shows a sectional illustration of the roller tool of FIG. 13, in section along a line XVII-XVII in FIG. 16.
Figure 18:
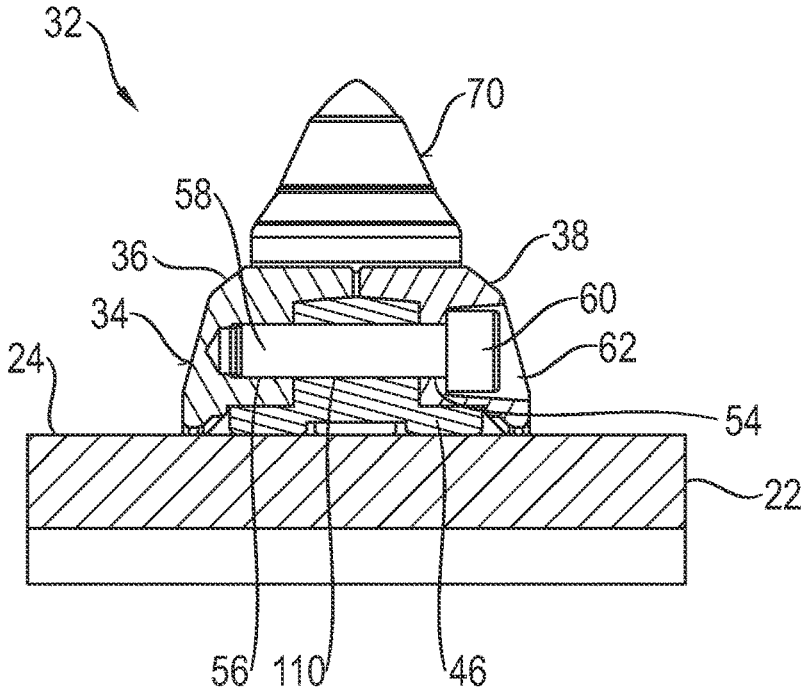
FIG. 18 shows a sectional illustration of the roller tool of FIG. 13, in section along a line XVIII-XVIII in FIG. 16.
Figure 19:
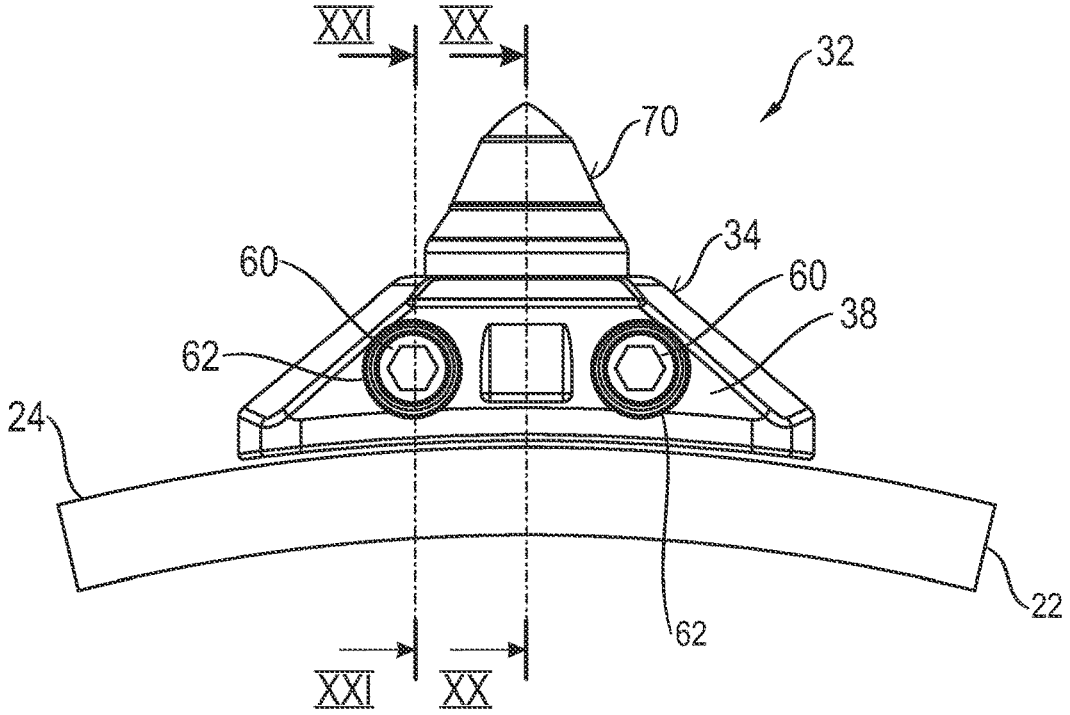
FIG. 19 shows a side view of a further alternative embodiment of a roller tool.

FIG. 12 shows an alternative embodiment of an exchangeable tool 70'. This forms a pad foot with its exchangeable tool body 72, which can be used in particular for compacting soil. The exchangeable tool body 72 is shaped so that in the assembled state it presses against the outer contour of the quick-change tool holder 34. In particular, the exchangeable tool body 72 has the same quick-change tool holder support sections 106 in the four corner regions which are pressed in the assembled state by the above-described interaction of the engagement recess 76 of the tool shaft 68 with the engagement projections 82 against complementary exchangeable tool support sections 108 of the quick-change tool holder body parts 36, 38 and thus ensure stable and play-free support of the exchangeable tool body 72 on the quick-change tool holder 34.

A further alternative embodiment of a roller tool is shown in FIGS. 13 to 18. In this embodiment, the structure of the roller tool 32 essentially corresponds to the above-described structure. This roller tool 32 also has the tool carrier 46 fixed on the outer circumferential side 24 of a roller cladding 22 by a preferably complete circumferential weld seam and a quick-change tool holder 34 constructed using two quick-change tool holder body parts 36, 38 constructed identically to one another. In this embodiment, it is preferably ensured that only the tool carrier 46 touches the roller cladding 22, while the two quick-change tool holder body parts 36, 38 and also the exchangeable tool 70 to be held by them have essentially no direct contact with the roller cladding 22. However, the quick-change tool holder body parts 36, 38 cover the weld seam fixing the tool carrier 46 on the roller cladding 22 and thus protect it from wear. In this embodiment as well, the tool carrier 46 has a chamfer 47 in its circumferential region adjoining the outer circumferential side 24 of the roller cladding 22, which ensures increased strength of the welding.

In contrast to the embodiment recognizable in FIG. 3, for example, in the exchangeable tool 32 of the embodiment of FIGS. 13 to 18, the two quick-change tool holder body parts 36, 38 are only fixed on the tool carrier 46 by two fastening elements 58 formed as threaded bolts. Each of the quick-change tool holder body parts 36, 38 has, assigned to one of the two fastening elements 58, a fastening element passage opening 54 having a fastening element head receptacle region 62. Furthermore, each of the two quick-change tool holder body parts 36, 38 has an internally threaded opening 56, into which a fastening element 58 guided through a fastening element passage opening 54 of the respective other quick-change tool holder body part 36, 38 can be screwed. For locking with respect to the tool carrier 46, this has, assigned to a respective pair made up of a fastening element passage opening 54 and an internally threaded opening 56, a passage opening 110, through which a fastening element 58 guided through a fastening element passage opening 54 and screwed into an internally threaded opening 56 extends.

Due to the design of the two quick-change tool holder body parts 36, 38 identically to one another, during the assembly, the two fastening elements 58 are inserted from sides of the quick-change tool holder 34 opposite to one another into the respective assigned fastening element passage opening 54 and screwed through the passage opening 110 into the internally threaded opening 56 of the respective other quick-change tool holder body part 36, 38.

A further alternative embodiment of a roller tool is shown in FIGS. 19 to 22. While in this embodiment, the structure and the attachment of the tool carrier 46 on the roller cladding 22 essentially correspond to the above-described embodiments, the two quick-change tool holder body parts 36, 38 of the quick-change tool holder 34 are not formed identically to one another. The exchangeable tool receptacle opening 64 is formed completely in the quick-change tool holder body part 38, for which purpose it has a lateral bulge 112, which is accommodated in a corresponding recess 114 of the other quick-change tool holder body part 36 when the two quick-change tool holder body parts 36, 38 are fixed on the tool carrier 46.

To fix the exchangeable tool 70 on the quick-change tool holder 34 or on the quick-change tool holder body part 38 having the exchangeable tool receptacle opening 64, a receptacle opening bottom 116, in which a passage opening 118 is formed, and which delimits the exchangeable tool receptacle opening 64 in the direction toward the roller cladding 22 or toward the tool carrier 46, is provided thereon, in which a passage opening 118 is formed. A fastening element 120 embodied as a threaded bolt can be screwed through the passage opening 118 in the receptacle opening bottom 116 into an internally threaded opening 122 of the tool shaft 68 of the exchangeable tool 70, whereby the exchangeable tool 70 is fixed on the quick-change tool holder body part 38. It can be seen in FIG. 20 that in this embodiment both the tool shaft 68 and also the exchangeable tool receptacle opening 64 accommodating it are formed essentially cylindrical, thus unstructured without projections and recesses, to be able to insert the tool shaft 68 in the direction of its longitudinal axis into the exchangeable tool receptacle opening 64.

Before the attachment of the two quick-change tool holder body parts 36, 38 on the tool carrier 46, the exchangeable tool 70 is fixed in the above-described manner on the quick-change tool holder body part 38. These parts are then positioned on both sides of the tool carrier 46, wherein a recess 126 is provided in the tool carrier 46 assigned to a head 124 of the fastening element 122 protruding downward, in which the head 124 engages when the quick-change tool holder body part 38 is positioned on the tool carrier 46. The head 124 of the fastening element 122 is thus shielded to the outside in working operation and protected from wear or damage.

After the positioning of the quick-change tool holder body parts 36, 38 on the tool carrier 46, these are fixed on one another and on the tool carrier 46 by two fastening elements 58 formed as threaded bolts. For this purpose, the quick-change tool holder body part 38 also providing the exchangeable tool receptacle opening 64 has a fastening element passage opening 54 assigned to each fastening element 58. The tool carrier 46 has a passage opening 110 assigned to each fastening element 58, and an internally threaded opening 56 is formed assigned to each fastening element 58 in the quick-change tool holder body part 36, into which this fastening element can be screwed. The two quick-change tool holder body parts 36, 38 are thus also fixed by only two fastening elements 58 on one another and on the tool carrier 46 in this embodiment, wherein, in contrast to the embodiment of FIGS. 13 to 18, the two internally threaded opening 56, on the one hand, and the two fastening element passage openings 54, on the other hand, are each positioned in the same quick-change tool holder body part 36 or 38, respectively.

Figure 20:
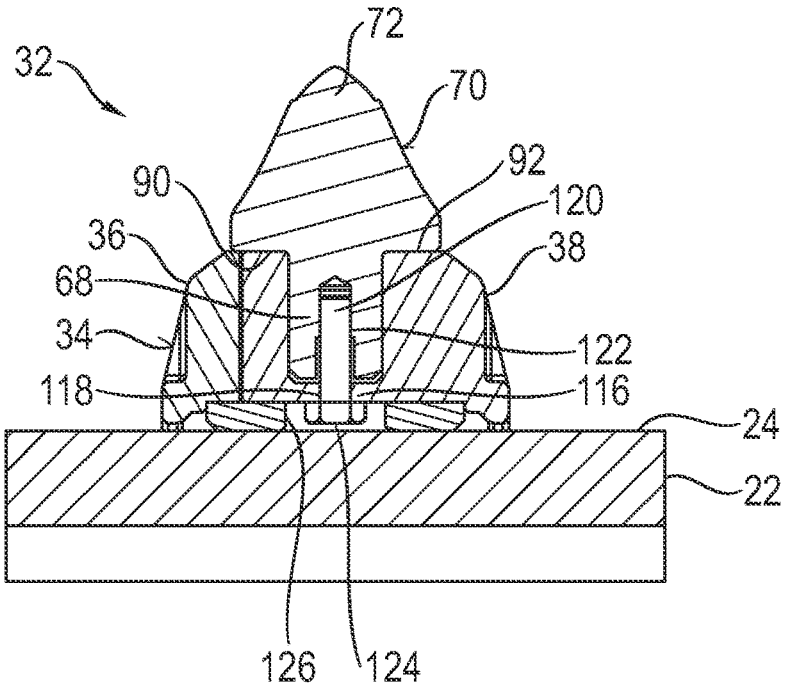
FIG. 20 shows a sectional illustration of the roller tool of FIG. 19, in section along a line XX-XX in FIG. 19.
Figure 21:
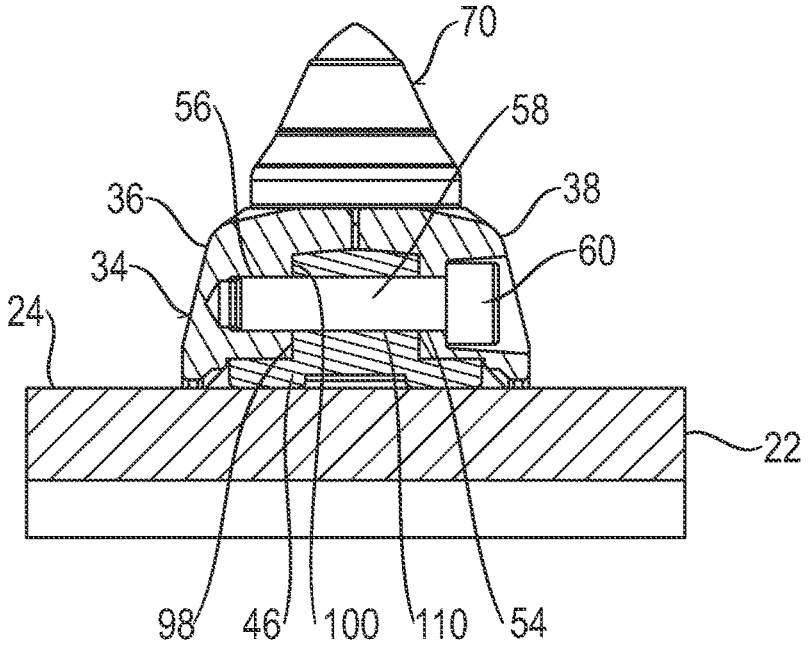
FIG. 21 shows a sectional illustration of the roller tool of FIG. 19, in section along a line XXI-XXI in FIG. 19.
Figure 22:
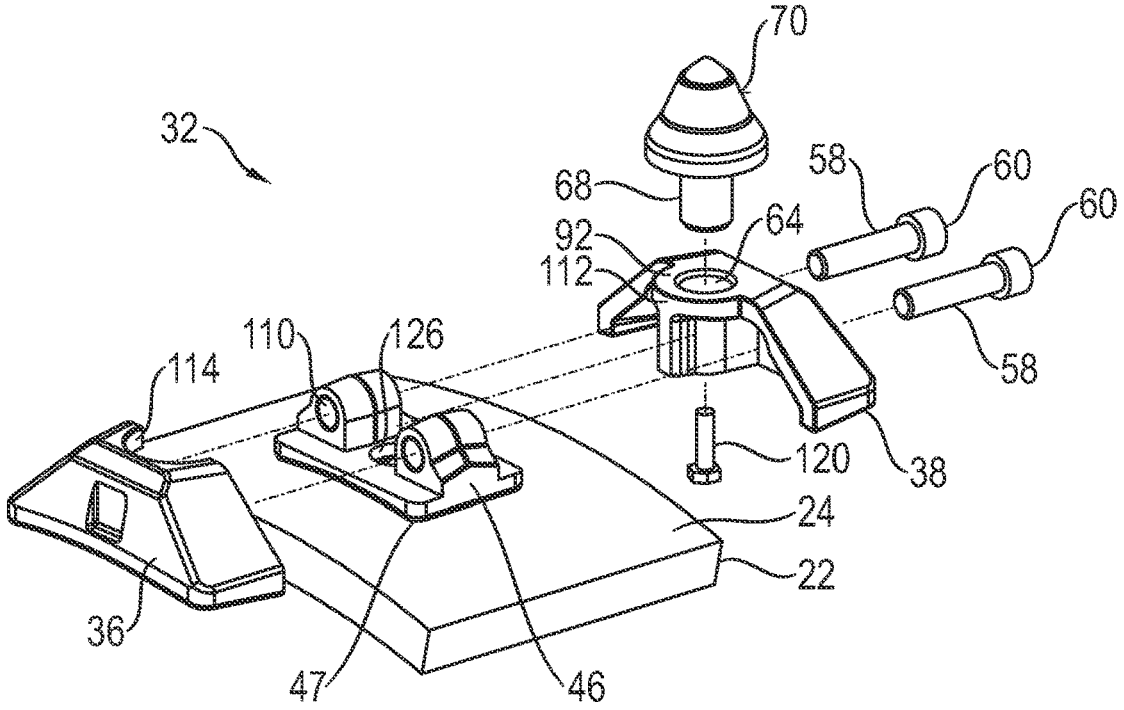
FIG. 22 shows a perspective exploded illustration of the roller tool of FIG. 19.

In the embodiment of a roller tool 32 shown in FIGS. 19 to 22, due to the circumstance that the exchangeable tool receptacle opening 64 is formed completely in the quick-change tool holder body part 38, the exchangeable tool support surface 92 is also provided completely and thus without circumferential interruption on the quick-change tool holder body part 38. Due to the circumstance that, as can be seen in FIG. 20, the tool shaft 68 is made somewhat shorter than the exchangeable tool receptacle opening 64 accommodating it, the exchangeable tool 70 can be tensioned with respect to the quick-change tool holder body part 38 by the fastening element 120 in such a way that the exchangeable tool 70 is tensioned fixedly against the exchangeable tool support surface 92 with its quick-change tool holder support surface 90.

In the embodiment of a roller tool 32 shown in FIGS. 19 to 22, the two quick-change tool holder body parts 36, 38 formed differently from one another are also stably carried on the tool carrier 46 in the manner described above with reference to the various other embodiments and completely cover the weld seam fixing this tool carrier on the roller cladding 22, so that it is protected from wear, without a direct support contact resulting between the two quick-change tool holder body parts 36, 38 and the outer circumferential side 24 of the roller cladding. Due to the interaction of the quick-change tool holder body parts 36, 38 or the tool carrier contact surfaces 100 formed thereon with the body part contact surfaces 98 of the tool carrier 46, the quick-change tool holder body parts 36, 38 are pre-tensioned in the direction toward the tool carrier 46 or the roller cladding 22 and radially inward with respect to the roller rotational axis, whereby the fixed bond between the quick-change tool holder body parts 36, 38 and the tool carrier 46 is reinforced. As stated above, a pre-tensioning against the outer circumferential side 24 of the roller cladding 22 can be implemented here, so that the quick-change tool holder body parts 36, 38 press with their regions enclosing the tool carrier 46 against the outer circumferential side 24 of the roller cladding 22 or are supported radially inward. Alternatively, in this and also all above-described embodiments, the quick-change tool holder body parts 36, 38 can be pre-tensioned radially inward against the tool carrier 46 and at the same time supported radially inward essentially on the platelike region of the tool carrier 46 fixed on the roller cladding 22 and also can cover the weld seam fixing the tool carrier 46 on the roller cladding 22, while the quick-change tool holder body parts 36, 38 themselves do not come into direct contact with the roller cladding 22. A gap-like intermediate space results here between the quick-change tool holder body parts 36, 38 and the outer circumferential side 24 of the roller cladding 22. The positioning of the quick-change tool holder 34 is independent here of changes in the structure of the roller cladding 22 on its outer circumferential side 24, which are induced by wear, for example.

Figure 23:
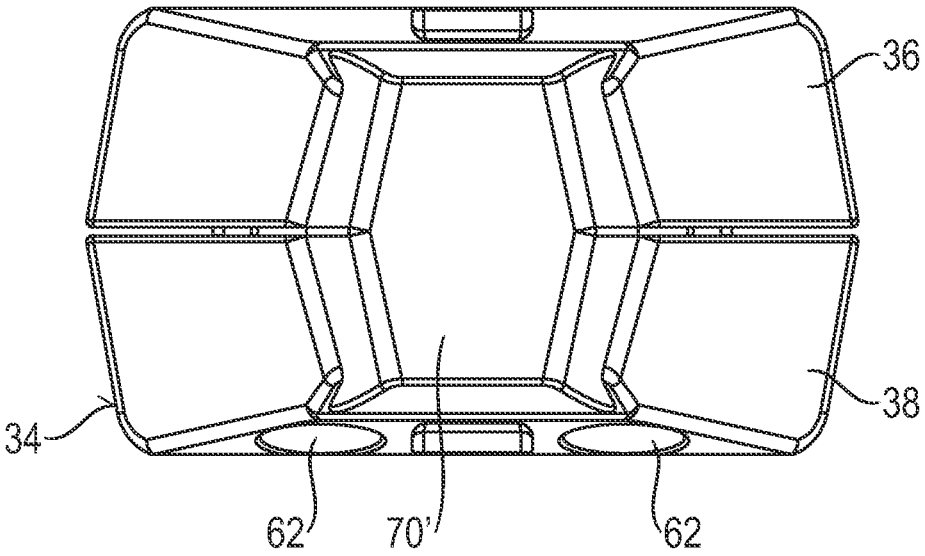
FIG. 23 shows a top view of the roller tool of FIG. 19 with an exchangeable tool formed as a pad foot.
Figure 24:
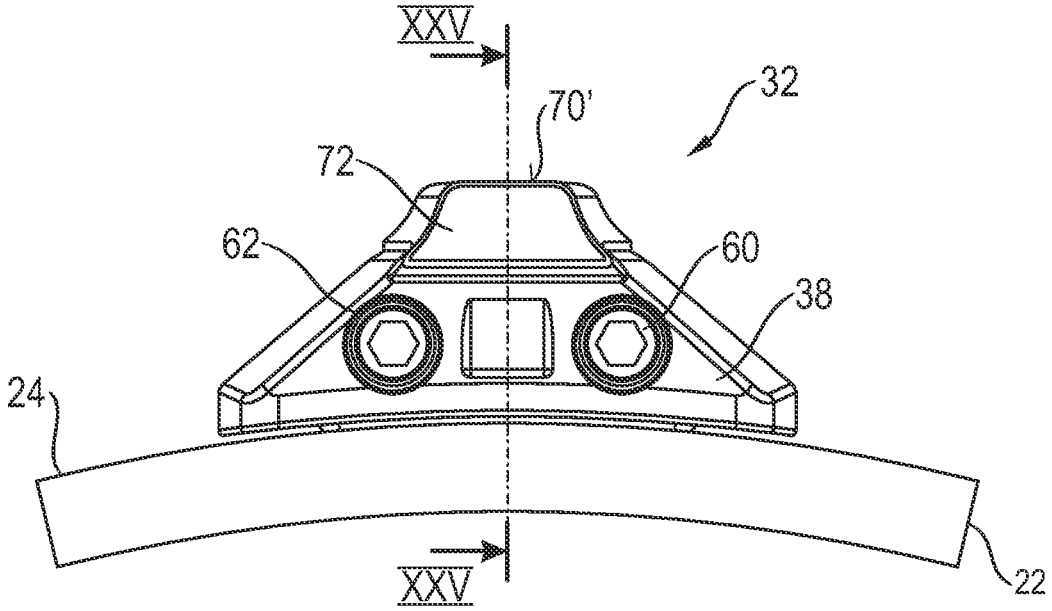
FIG. 24 shows a side view of the roller tool of FIG. 23.
Figure 25:
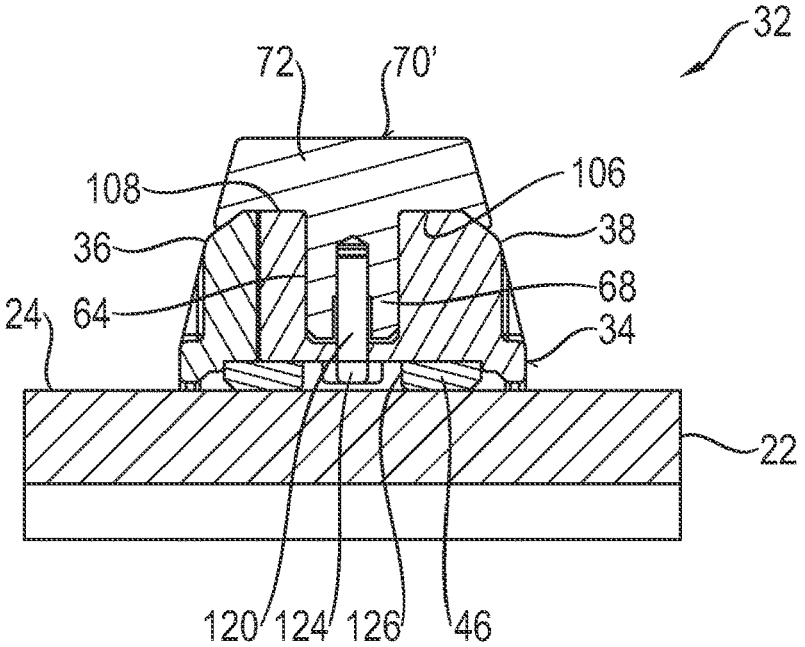
FIG. 25 shows a sectional illustration of the roller tool of FIG. 23, in section along a line XXV-XXV in FIG. 24.
Figure 26:
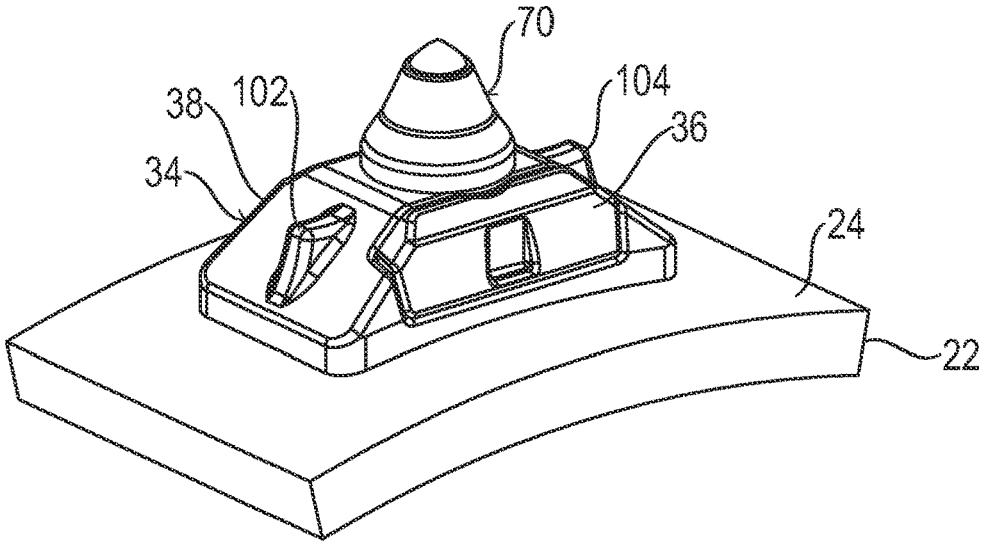
FIG. 26 shows a perspective view of a further alternative embodiment of a roller tool.
Figure 27:
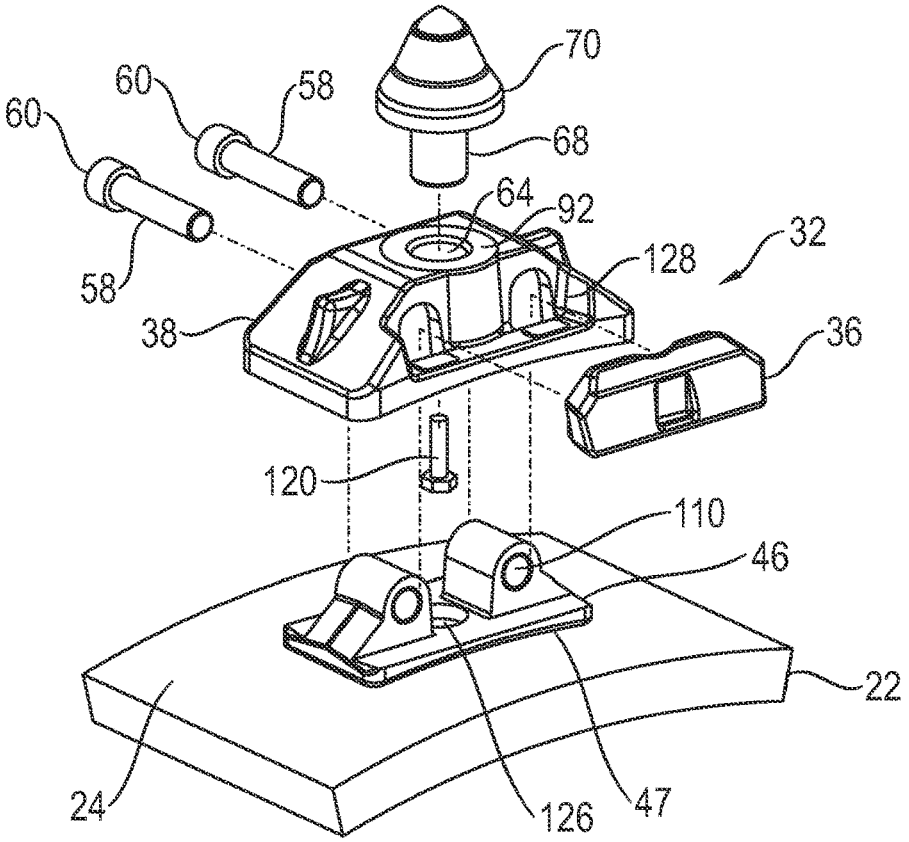
FIG. 27 shows a perspective exploded illustration of the roller tool of FIG. 26.
Figure 28:
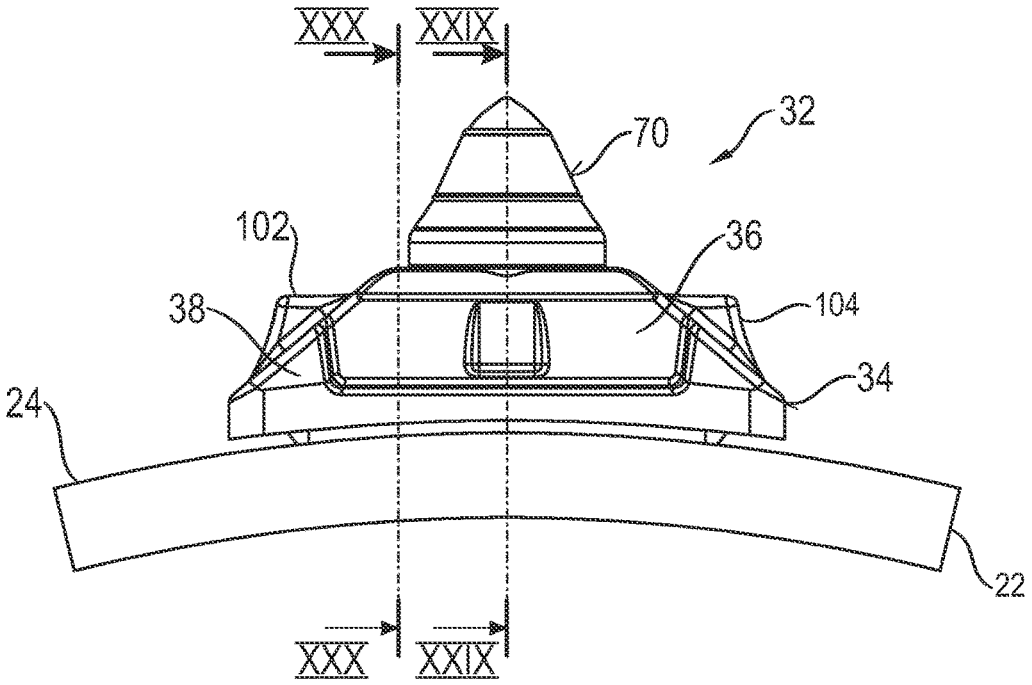
FIG. 28 shows a side view of the roller tool of FIG. 26.
Figure 29:
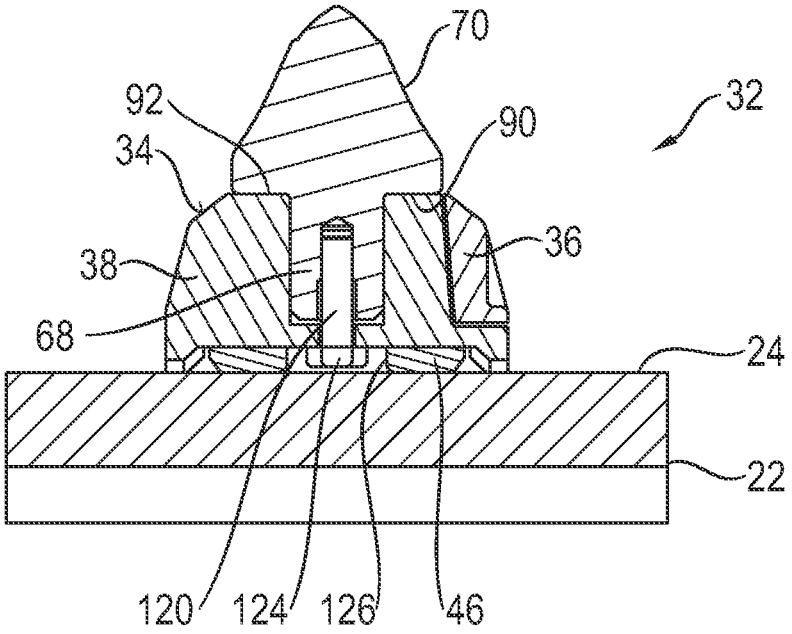
FIG. 29 shows a sectional illustration of the roller tool of FIG. 26, in section along a line XXIX-XXIX in FIG. 28.
Figure 30:
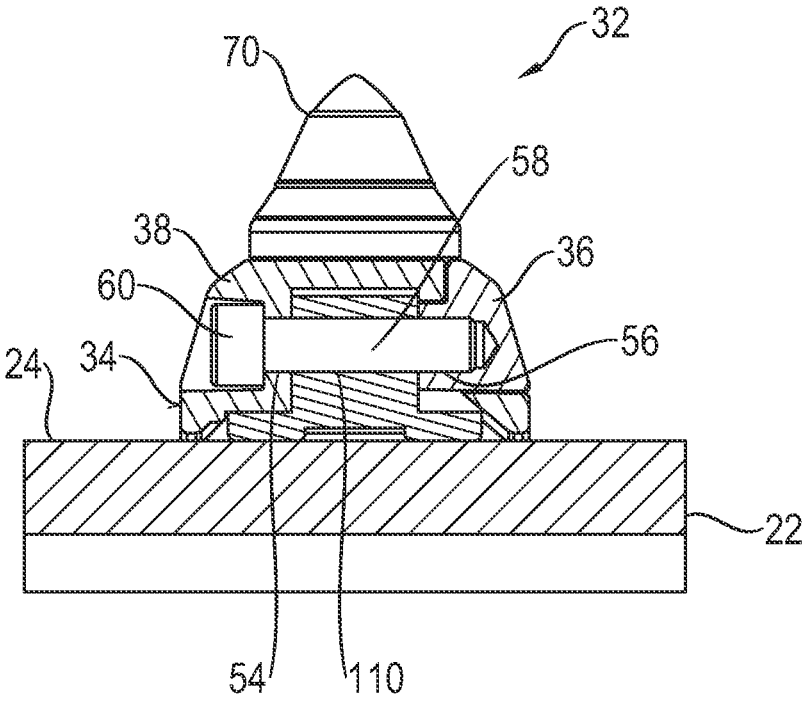
FIG. 30 shows a sectional illustration of the roller tool of FIG. 26, in section along a line XXX-XXX in FIG. 28.

FIGS. 23 to 25 show that an exchangeable tool 70' formed as a pad foot can also be used in this embodiment of a quick-change tool holder having quick-change tool holder body parts not constructed identically to one another. This tool can have, as also described above with reference to FIG. 12, quick-change tool holder support sections in lateral regions or in corner regions, for example, which press against complementary exchangeable tool support sections of the quick-change tool holder body parts 36, 38. To simplify the assembly, it could also be provided that, similarly as in the above-described embodiment having an exchangeable tool 70 formed as a chisel, such a quick-change tool holder support section 106 is formed as a circumferential surface around the tool shaft 68 on the exchangeable tool body 72. A complementary exchangeable tool support section 108 is then provided by a ring-like face on the quick-change tool holder body part 38 enclosing the exchangeable tool receptacle opening 64.

FIGS. 26 to 30 show a modification of the embodiment of a roller tool 32 shown in FIGS. 19 to 25. The two quick-change tool holder body parts 36, 38 are also formed in the embodiment of a roller tool 32 shown in FIGS. 26 to 30, so that the exchangeable tool receptacle opening 64 is formed completely in the quick-change tool holder body part 38. The quick-change tool holder body part 36, which, as in the embodiment of FIGS. 19 to 25, is used to provide the internally threaded openings 56 for screwing in the fastening elements 58 to be guided through the fastening element passage openings 54 of the quick-change tool holder body part 38 and the passage openings 110 of the tool carrier 46, is dimensioned significantly smaller in the embodiment of FIGS. 26 to 30, however, than in the embodiment of FIGS. 22 to 25.

In assignment to the quick-change tool holder body part 36, the quick-change tool holder body part 38 has a quick-change tool holder body part receptacle recess 128 on one side, which is open in the lateral direction and in the direction away from the roller cladding 22. In the assembled state, the quick-change tool holder body part 36 is accommodated essentially completely in the quick-change tool holder body part receptacle recess 128, so that essentially no steps are formed in the transition to the other quick-change tool holder body part 38, but rather the outer surfaces of these two quick-change tool holder body parts 36, 38 merge into one another nearly flush.

During the assembly of such a roller tool 32 shown in FIGS. 26 to 30, as described above with reference to FIGS. 19 to 25, first the exchangeable tool 70 or 70' is inserted with its tool shaft 68 into the exchangeable tool receptacle opening 64 of the quick-change tool holder body part 38 and fixed therein by the fastening element 120. The quick-change tool holder body part 38 is subsequently placed from the radial outside on the assigned tool carrier 46, and the fastening elements 58 are guided through the fastening element passage openings 54 and the passage openings 110 and screwed into the quick-change tool holder body part 36 to be positioned in the quick-change tool holder body part receptacle recess 128.

With the structure according to the invention of a roller tool, in which only a respective tool carrier is non-detachably fixed on a carrier cladding, for example by welding, the possibility is provided in a simple manner of replacing both the quick-change tool holder and also the roller tool held on a respective quick-change tool holder if necessary. Since both the fastening elements fixing the quick-change tool holder on the tool carrier are protected from access wear and also the tool carrier itself is protected by the quick-change tool holder against wear due to external action, the quick-change tool holder and with it the exchangeable tool detachably held thereon can be replaced easily even after long operation and strong wear thus induced, without having to act on the quick-change tool holder by way of welding tools or the like.

The invention claimed is:

1. A roller tool for a ground processing roller of a ground processing machine, comprising a tool carrier configured to be fixed on an outer circumferential side of a carrier cladding of a soil compaction roller, a quick-change tool holder configured to be detachably fixed on the tool carrier, and an exchangeable tool configured to be detachably fixed on the quick-change tool holder, wherein the quick-change tool holder comprises two quick-change tool holder body parts, wherein when the quick-change tool holder is fixed on the tool carrier, the two quick-change tool holder body parts form a tool carrier receptacle space accommodating the tool carrier and are fixed by fastening elements on the tool carrier.

2. The roller tool as claimed in claim 1, wherein the two quick-change tool holder body parts are constructed identically to one another, and/or in that each quick-change tool holder body part has a tool carrier receptacle recess providing a part of the tool carrier receptacle space, and/or in that each quick-change tool holder body part has a carrier cladding contact surface to be positioned facing toward an outer circumferential side of a carrier cladding and fitted to an outer circumferential contour of the carrier cladding.

3. The roller tool as claimed in claim 1, wherein each quick-change tool holder body part is fixable by at least one fastening element on the tool carrier, wherein each quick-change tool holder body part has at least one fastening element passage opening having an expanded fastening element head receptacle region for receiving said at least one fastening element.

4. The roller tool as claimed in claim 1, wherein the tool carrier has two body part contact surfaces, and each quick-change tool holder body part has a tool carrier contact surface for contact on one of the two body part contact surfaces of the tool carrier, wherein the body part contact surfaces are arranged on sides of the tool carrier facing away from one another, wherein a mutual distance of the two body part contact surfaces of the tool carrier increases starting from a carrier cladding contact side of the tool carrier.

5. The roller tool as claimed in claim 4, wherein the tool carrier contact surfaces of the two quick-change tool holder body parts are arranged complementary to the two body part contact surfaces of the tool carrier, wherein when the quick-change tool holder body parts are fixed on the tool carrier, a mutual distance of the tool carrier contact surfaces of the two quick-change tool holder body parts increases in a direction away from the carrier cladding contact side of the tool carrier.

6. The roller tool as claimed in claim 1, wherein the quick-change tool holder has an exchangeable tool receptacle opening for accommodating a tool shaft, extending in a direction of a shaft longitudinal axis from an exchangeable tool body, of the exchangeable tool to be fixed on the quick-change tool holder.

7. The roller tool as claimed in claim 6, wherein each quick-change tool holder body part has an exchangeable tool receptacle recess providing a part of the exchangeable tool receptacle opening.

8. The roller tool as claimed in claim 7, wherein the tool shaft has an engagement recess extending completely around the shaft longitudinal axis in a circumferential direction, and in that each quick-change tool holder body part has, in a region of the exchangeable tool receptacle recess, an engagement projection to be positioned in an engaging manner in the engagement recess.

9. The roller tool as claimed in claim 8, wherein the engagement recess is delimited in a direction away from the exchangeable tool body by an engagement recess end face, wherein the engagement recess end face is angled with respect to the shaft longitudinal axis, wherein a distance of the engagement recess end face to the exchangeable tool body increases starting from a recess bottom.

10. The roller tool as claimed in claim 9, wherein on each quick-change tool holder body part, the engagement projection is delimited by an engagement projection end face, wherein when the exchangeable tool is fixed on the quick-change tool holder, the engagement projection end face is oriented in the direction away from the exchangeable tool body and is angled with respect to the shaft longitudinal axis, wherein a distance of the engagement projection end face to the exchangeable tool body decreases in the direction toward a projection vertex of the engagement projection.

11. The roller tool as claimed in claim 6, wherein an exchangeable tool support surface enclosing the exchangeable tool receptacle opening is provided on the quick-change tool holder.

12. The roller tool as claimed in claim 11, wherein the quick-change tool holder comprises two quick-change tool holder body parts, wherein a partial surface of the exchangeable tool support surface is provided on each quick-change tool holder body part.

13. The roller tool as claimed in claim 6, wherein the exchangeable tool receptacle opening is formed completely in one of the quick-change tool holder body parts.

14. The roller tool as claimed in claim 13, wherein in a receptacle opening bottom of the exchangeable tool receptacle opening, a passage opening is provided for an exchangeable tool fastening element fixing the tool shaft with respect to the one quick-change tool holder body part.

15. The roller tool as claimed in claim 13, wherein an exchangeable tool support surface enclosing the exchangeable tool receptacle opening is provided on the one quick-change tool holder body part, and/or in that a quick-change tool holder body part receptacle recess accommodating the other quick-change tool holder body part is provided in the one quick-change tool holder body part.

16. The roller tool as claimed in claim 1, wherein when the quick-change tool holder is fixed on the tool carrier and the exchangeable tool is fixed on the quick-change tool holder, the exchangeable tool is pre-tensioned with a support region in contact on the quick-change tool holder.

17. The roller tool as claimed in claim 16, wherein each quick-change tool holder body part has an exchangeable tool receptacle recess providing a part of the exchangeable tool receptacle opening, wherein the tool shaft has an engagement recess extending completely around the shaft longitudinal axis in a circumferential direction, and each quick-change tool holder body part has, in a region of the exchangeable tool receptacle recess, an engagement projection to be positioned in an engaging manner in the engagement recess, wherein the exchangeable tool is pre-tensioned by the engagement projections engaging in the engagement recess, wherein the support region is in contact on the quick-change tool holder.

18. The roller tool as claimed in claim 16, wherein the support region on the exchangeable tool body has a ring-like quick-change tool holder support surface enclosing the tool shaft at least in regions.

19. The roller tool as claimed in claim 16, wherein the support region on the exchangeable tool body has a plurality of quick-change tool holder support sections arranged with a radial distance to the shaft longitudinal axis and with a circumferential distance around the shaft longitudinal axis to one another.

20. The roller tool as claimed in claim 19, wherein an exchangeable tool support section is provided on the quick-change tool holder assigned to each quick-change tool holder support section.

21. A ground processing roller, comprising a roller cladding, which provides a carrier cladding and encloses a roller rotational axis, and a plurality of roller tools as claimed in claim 1, wherein the tool carrier of each of the roller tools is fixed on the roller cladding.

22. The ground processing roller as claimed in claim 21, wherein when the quick-change tool holder is fixed on a tool carrier, the quick-change tool holder is pre-tensioned radially inward against the tool carrier and/or the roller cladding.

23. A casing for a ground processing roller, comprising a plurality of casing segments, which provide a carrier cladding and are to be arranged casing a roller cladding of a ground processing roller enclosing a roller rotational axis, and a plurality of roller tools as claimed in claim 1, wherein the tool carrier of each of the roller tools is fixed on one of the casing segments.

24. The casing as claimed in claim 23, wherein when the quick-change tool holder is fixed on a tool carrier, the quick-change tool holder is pre-tensioned radially inward against the tool carrier and/or the carrier cladding.

* * * * *